US007087354B2

(12) United States Patent
Nakamura et al.

(10) Patent No.: US 7,087,354 B2
(45) Date of Patent: Aug. 8, 2006

(54) NON-CONTACT HEAT FIXING COLOR TONER AND IMAGE-FORMING METHOD

(75) Inventors: Minoru Nakamura, Takarazuka (JP); Yoshihiro Mikuriya, Nishinomiya (JP); Junichi Tamaoki, Sakai (JP); Masahiro Anno, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 239 days.

(21) Appl. No.: 10/690,586

(22) Filed: Oct. 23, 2003

(65) Prior Publication Data

US 2004/0131962 A1 Jul. 8, 2004

(30) Foreign Application Priority Data

Nov. 1, 2002 (JP) ..... 2002-319894

(51) Int. Cl.
*G03G 9/08* (2006.01)

(52) U.S. Cl. ..... 430/108.21; 430/108.2; 430/108.4; 430/108.8; 430/109.4; 430/126

(58) Field of Classification Search ..... 430/108.21, 430/108.2, 108.4, 108.8, 109.4, 126
See application file for complete search history.

(56) References Cited

U.S. PATENT DOCUMENTS

| | | | | |
|---|---|---|---|---|
| 6,136,488 | A | 10/2000 | Kushino et al. | |
| 2003/0044710 | A1* | 3/2003 | Horikoshi et al. | 430/111.4 |
| 2003/0049553 | A1* | 3/2003 | Nakamura et al. | 430/108.21 |
| 2004/0043318 | A1* | 3/2004 | Sato et al. | 430/109.4 |
| 2004/0142263 | A1* | 7/2004 | Mikuriya et al. | 430/108.2 |

FOREIGN PATENT DOCUMENTS

| | | |
|---|---|---|
| JP | 2001-22127 | 1/2001 |
| JP | 2001-92174 | 4/2001 |
| JP | 2002-99111 | 4/2002 |

* cited by examiner

*Primary Examiner*—John L. Goodrow
(74) *Attorney, Agent, or Firm*—Buchanan Ingersoll PC

(57) ABSTRACT

The present invention relates to a toner, comprising a binder resin, a colorant and two kinds of infrared absorbing agents, and having a maximum absorbance of the toner in a wavelength range of 810 to 870 nm that is greater, preferably two or more times greater than the maximum absorbance of the toner in a wavelength range of 870 to 1,000 nm, and also relates to an image-forming method which uses a flash fixing system with a xenon lamp serving as its light source, and is characterized by using the above-mentioned toner.

21 Claims, 2 Drawing Sheets

NON-CONTACT HEAT FIXING COLOR TONER AND IMAGE-FORMING METHOD

This application is based on application(s) No. 2002-319894 filed in Japan, the contents of which are hereby incorporated by reference.

BACKGROUND OF THE INVENTION

1. Field of the Invention

The present invention relates to a toner used for developing an electrostatic latent image formed by an electrophotographic method, an electrostatic recording method or the like, and more particularly concerns a color toner that is suitable for a non-contact heat fixing system.

2. Description of the Related Art

With respect to the method for heat-fixing a toner image on copying paper, there are basically two methods, that is, a contact heat fixing system and a non-contact heat fixing system. The non-contact heat fixing system is a fixing system in which upon fixing, no members contact an image made from toner powder, and mainly classified into a flash fixing system and an oven (atmosphere) fixing system.

In the flash fixing system, a powder toner image, transferred onto copying paper from a photosensitive member or an intermediate transferring member, is irradiated with flash light from, for example, a xenon lamp, a halogen flash lamp or the like so that the toner image is fused by the radiation heat, and fixed onto the copying paper.

In the oven fixing system, a powder toner image, transferred onto copying paper from a photosensitive member or an intermediate transferring member, is irradiated with infrared rays under an oven atmosphere so that the toner image is fused by the radiation heat, and fixed onto the copying paper.

These non-contact heat fixing systems have the following superior features.

- Since the powder toner image is fused and fixed without contacting any members, the toner image is free from damages caused by those members so that upon developing, there is no degradation in the resolution.
- Since the fixing time is very short, a high-speed fixing process is available.
- Since no waiting time is required for the fixing process, it is possible to start the process quickly.
- These systems are readily applied to various kinds of copying paper having different thicknesses and qualities.

However, since the non-contact heat fixing system carries out a heat fixing process in a non-contact state, its ambient energy dissipation is great. From the environmental viewpoint, there have been demands for a reduction in fixing energy. Even under such circumstances, when the total amount of light energy to reach the powder toner image is insufficient, the powder toner image is not sufficiently fused, resulting in the problem of insufficient fixing characteristics. In particular, in the case of a full-color image in which black images and color images are simultaneously printed, since the amount of energy to be absorbed is different depending on the respective colors, it is very difficult to control the amount of energy to be applied.

For this reason, in order to achieve a sufficient melt-fixing process, for example, the following toners have been proposed: a color toner containing at least a binder resin, an infrared absorbing agent, a colorant and a specific ester compound (for example, see Japanese Patent Application Laid-Open No. 2001-22,127 (page 2), Japanese Patent Application Laid-Open No. 2001-92,174 (page 2)), and a flash-fixing toner, which relates to a flash-fixing toner that is used for an image having toners of three colors or more laminated thereon, and contains an infrared absorbing pigment the absorbance in 650 nm of which is set to not more than 10% of the absorbance in the spectrum absorbing maximum wavelength in the infrared range, and which is characterized by containing at least two kinds of infrared absorbing pigments which have absorbing maximum wavelengths that deviate from each other by not less than 20 nm (see Japanese Patent Application Laid-Open No. 2002-99,111 (page 2)).

However, the above-mentioned toner has failed to provide sufficient color fixing properties depending on types and fixing conditions of images. For example, in the case when the fixing energy is comparatively small, even if desired color reproducibility is obtained in the case of a solid image having a great amount of toner adhesion, there is degradation in the color reproducibility when an image having a comparatively small amount of toner adhesion, such as a character image and a half-tone image, is fixed. This problem is more conspicuous in a half-tone image than in a character image, when the amount of toner adhesion is the same. In the case of a (full) color image including full-color portions and mono-color portions, the mono-color portions (except for black portions) that have a smaller amount of toner adhesion tend to have degradation in the fixing property. In order to improve the fixing property, when the amount of energy exerted on the fixing property is increased, the energy absorption becomes excessive in the black toner portions, causing a bumping phenomenon and the resulting noise. In the case when copy paper bearing an image formed on at least one surface thereof is fed, the fixed image tends to be rubbed against a roller or the like to cause degradation in the image quality such as blurring or stains (degradation in the smearing preventive property).

SUMMARY OF THE INVENTION

The present invention is to provide a non-contact heat fixing color toner which exerts sufficient fixing property and smearing preventive property, even when the fixing energy and amount of toner adhesion are comparatively small. In other words, the toner of the present invention exerts desirable fixing property and smearing preventive property with comparatively low fixing energy, even when an image, such as a mixed image with solid images, dot images, half-tone images and character images, a mixed image with black portions and color portions and a mixed image with full-color portions and mono-color portions, is formed.

The present invention is also to provide a full-color image-forming method which provides an image having superior fixing property and smearing preventive property even when the fixing energy and amount of toner adhesion are comparatively small.

The present invention relates to a toner which comprises a binder resin, a colorant and two kinds of infrared absorbing agents, and has a maximum absorbance of the toner in a wavelength range of 810 to 870 nm that is greater than the maximum absorbance of the toner in a wavelength range of 870 to 1,000 nm, the toner being suitable as a non-contact heat fixing color toner.

The present invention also relates to an image-forming method which uses a flash fixing system with a xenon lamp serving as its light source, and is characterized by using the above-mentioned toner.

DETAILED DESCRIPTION OF THE INVENTION

The present invention relates to a toner, comprising a binder resin, a colorant and two kinds of infrared absorbing agents, and having a maximum absorbance of the toner in a wavelength range of 810 to 870 nm that is greater, preferably two or more times greater than the maximum absorbance of the toner in a wavelength range of 870 to 1,000 nm.

In the present specification, the absorbance represents an amount that indicates the degree in which a substance is allowed to absorb light.

The maximum absorbance refers to the greatest absorbance in an absorbing curve that represents the relationship between the wavelength of light (axis of abscissas) and the absorbance (axis of ordinates). When a specific wavelength area is designated, the maximum absorbance represents the greatest absorbance within the corresponding wavelength area. Here, in the present specification, the absorbing curve represents an absorbing curve of the wavelength range of 700 to 1,100 nm.

The maximum absorbing peak refers to the greatest (highest) peak among peaks at which the absorbance shows maximum values in the absorbing curve. Upon designating a specific wavelength range, the maximum absorbing peak refers to the greatest (highest) peak within the corresponding wavelength range.

Figure 1:
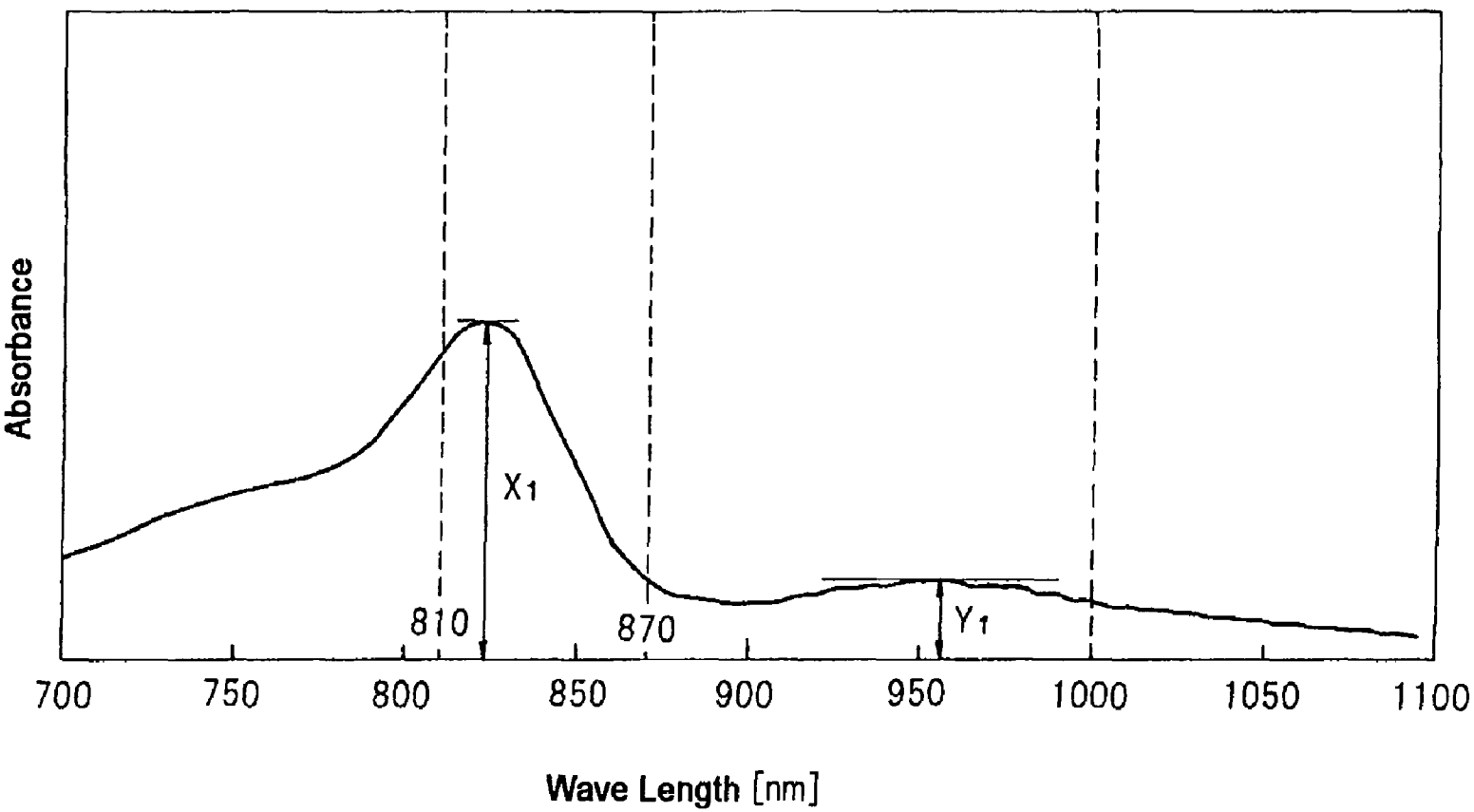
FIG. 1 shows an absorbance curve of one example of a toner of the present invention.

The non-contact heat fixing color toner of the present invention is designed to have a maximum absorbance of the toner in a wavelength range of 810 to 870 nm (hereinafter, referred to as maximum absorbance X) that is two or more times greater than the maximum absorbance of the toner in a wavelength range of 870 to 1,000 nm (in particular, wavelength range of 870 nm or more to not more than 1,000 nm), preferably 2 to 10 times, more preferably 2.5 to 10 times, most preferably 3 to 9 times, by far the most preferably 4 to 7 times. For example, in FIG. 1 that shows an absorbing curve of one example of a toner of the present invention, $X_1$ represents the maximum absorbance X of the toner in the wavelength range of 810 to 870 nm, and $Y_1$ represents the maximum absorbance Y of the toner in the wavelength range of 870 to 1,000 nm.

In the present invention, the toner is designed to satisfy the above-mentioned light-absorbing characteristics so that the toner is allowed to effectively absorb light energy and convert it to thermal energy; thus, each of the toner particles is sufficiently fused. Conventionally, in the field of the non-contact heat-fixing toner, when, upon forming an image including portions having low image densities or reducing the amount of adhesion at solid portions, the amount of toner adhesion is reduced to a comparatively small amount of, for example, not more than 2 g/m$^2$, a problem of degradation in the fixing property tends to arise. The reason for this phenomenon is explained as follows: In the case of a comparatively great amount (approximately 5 g m$^2$) of toner adhesion, toner particles are closely placed on a recording medium so that heat is hardly released externally, and transmitted through the respective particles; thus, a sufficient fixing property is obtained. However, in the case of a comparatively small amount of toner adhesion, toner particles are placed on a recording medium in respectively isolated states with the result that one portion of radiation heat is released to the recording medium and surroundings, making it difficult to ensure sufficient radiation heat required for the toner particle to melt. However, in the present invention, the individual toner particles are allowed to sufficiently melt as described above, and even in the case of small amount of toner adhesion and in particular, in the case when toner particles are isolated on the surface of paper, the toner particles are allowed to sufficiently permeate into the recording medium, thereby making it possible to improve the fixing property as the non-contact heat fixing color toner (in the present specification, referred to simply as "fixing property"). Since the toner on a recording medium is effectively fused in a non-contact state, the toner image height is reduced and irregularities are minimized, making it possible to improve the smoothness. Thus, it becomes possible to improve the smearing preventive property. In particular, even in the case of a comparatively small fixing energy of 3 to 5 J/cm$^2$, it becomes possible to achieve superior fixing property and smearing preventive property in full color images. When the ratio of maximum absorbance X/maximum absorbance Y is less than 2, an insufficient fixing process and degradation in the smearing preventive property occur. For example, even in the case of toner having a comparatively high amount of adhesion such as 5 g/m$^2$, an insufficient fixing process and degradation in the smearing preventive property occur. When the ratio of maximum absorbance X/maximum absorbance Y is too high, it becomes difficult to absorb light energy in long-wavelength ranges.

In the toner of the present invention, the maximum absorbing peak is preferably set in a wavelength range of 810 to 840 nm within a wavelength range of 810 to 1,000 nm. By applying the toner to a non-contact heat fixing system using a light source having a light-emitting spectrum peak at least within a wavelength range of 810 to 840 nm, it is possible to more effectively absorb light energy, and consequently to reduce the amount of addition of an infrared-ray absorbing agent. Thus, it becomes possible to cut toner production costs, and also to prevent degradation in the charging characteristic and the like in the toner. It is possible to minimize a change in colors in the color toner due to the infrared-ray absorbing agent, and consequently to provide a color image that is superior in the color reproducibility.

In the present invention, the absorbance and absorbing peak are read from an absorbing curve, and the absorbing curve is measured by a spectrophotometer (model U-4100 manufactured by Hitachi, Ltd.). However, the absorbing curve is not necessarily measured by the above-mentioned device, and any device may be used, as long as the relationship between the light wavelength (axis of abscissas) and absorbance (axis of ordinates) in the toner and the infrared-ray absorbing agent can be measured in a wavelength range of 700 to 1100 nm.

The toner of the present invention contains at least a binder resin, a colorant and two kinds of infrared-ray absorbing agents, and among these components, in particular, the two kinds of infrared-ray absorbing agents are properly selected so as to satisfy the above-mentioned light-absorbing properties.

More specifically, with respect to the infrared absorbing agents (IR absorbing agent), in order to allow the toner to satisfy the above-mentioned light-absorbing characteristics, at least two kinds of compounds are selected from the group consisting of a cyanine-based compound, a polymethine-based compound, an aminium-based compound, a diimmonium-based compound, a phthalocyanine-based compound, a merrocyanine-based compound, a benzene-thiol-based metal complex, a mercaptophenol-based metal complex, an aromatic diamine-based metal complex, a nickel complex compound, an anthraquinone-based compound and a naphthalocyanine-based compound, and used.

In the present invention, from the viewpoint of controlling toner light-absorbing characteristics, among the above-mentioned compounds, at least two kinds of compounds having an absorbing peak (in particular, the maximum absorbing peak) in a wavelength range of 800 to 1,000 nm are preferably used. More preferably, with respect to at least one kind of these compounds, a compound having an absorbing peak (in particular, the maximum absorbing peak) in a wavelength range of 800 to 870 nm, more preferably 810 to 840 nm, is used. In this case, most preferably, a compound having an absorbing peak (in particular, the maximum absorbing peak) in a wavelength range of 870 to 1,000 nm (in particular, a wavelength range exceeding 870 nm to not more than 1,000 nm), more preferably, a wavelength range of 900 to 980 nm, is used in combination.

With respect to the compound having the maximum absorbing peak in a wavelength range of 800 to 870 nm, examples thereof include compounds such as a polymethine-based compound and a cyanine-based compound. The cyanine-based compound is preferably used since it effectively absorbs light even in the case of small light energy and since it hardly gives adverse effects to the color reproducibility of a color toner. Since the cyanine-based compound has a sharp peak (apex) in the absorbing spectrum, it efficiently absorbs light in the necessary wavelength range, and it is also preferable since its absorption is small in the visible range. With respect to a method for shifting the absorbing peak of the cyanine-based compound to a desired wavelength range, this is achieved by properly selecting the number of conjugated double bonds and the kinds of heterocyclic rings that are bonded to the respective ends of the compound. The absorbing peak is finely adjusted by inserting substituents onto atoms that form a heterocyclic core and the conjugated double bond. In order to allow the absorbing peak to shift to the long-wavelength side, those compounds having a laterally symmetrical shape in the structural formula are preferably used.

With respect to the compound having the maximum absorbing peak in a wavelength range of 870 to 1,000 nm, examples thereof include a diimmonium-based compound, a phthalocyanine-based compound and an aminium-based compound. The aminium-based compound is preferably used since it hardly gives adverse effects to the color reproducibility of a color toner.

With respect to specific examples for the cyanine-based compound having the maximum absorbing peak in a wavelength range of 800 to 870, compounds represented by the following formulas (I) to (VII) are proposed.

(I)

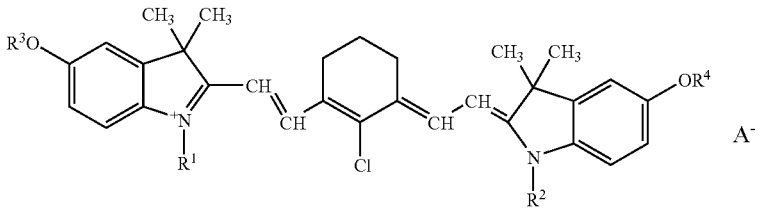

(II)

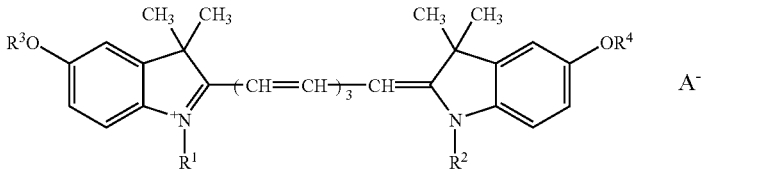

(III)

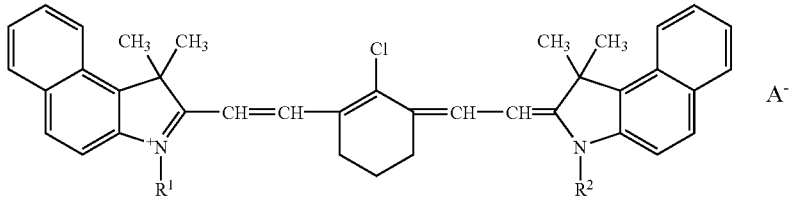

(IV)

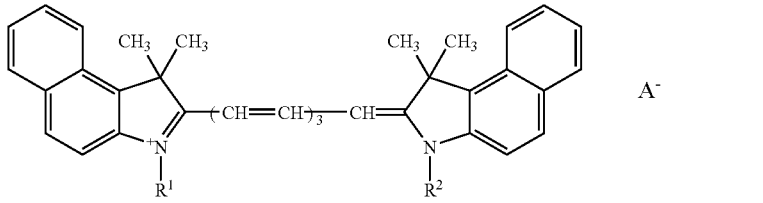

-continued (V)

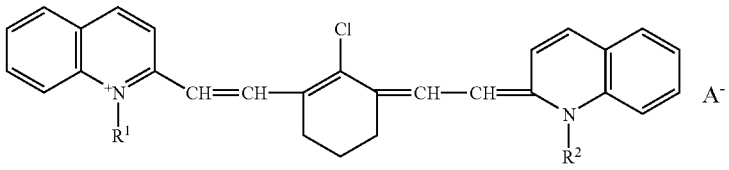

(VI)

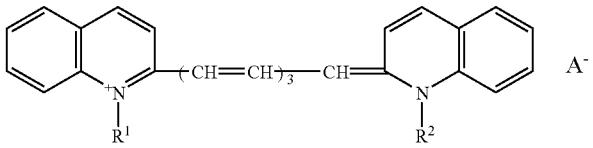

(VII)

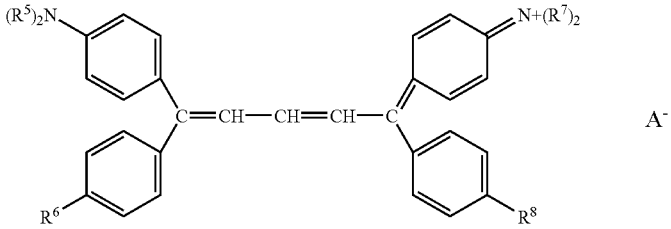

In formulas (I) to (VII), $R^1$ to $R^4$ and $A^-$ are commonly used. Each of $R^1$ and $R^2$ is a hydrogen atom or a substituted or unsubstituted hydrocarbon group independently. Each of $R^3$ and $R^4$ represents an unsubstituted alkyl group having a total of not more than 12 carbon atoms independently. Each of $R^5$ and $R^7$ represents an unsubstituted alkyl group having a total of not more than 3 carbon atoms independently. Each of $R^6$ and $R^8$ represents a hydrogen atom, an unsubstituted alkyl group having a total of not more than 3 carbon atoms or an alkyl-substituted amino group having a total of not more than 6 carbon atoms. Here, $A^-$ represents an anion that is present, if necessary.

Specific examples of $R^1$ and $R^2$ include: a hydrogen atom or a straight-chain or branched-chain alkyl group, such as a methyl group, an ethyl group, an iso-propyl group, an n-propyl group, an n-butyl group, an iso-butyl group, a t-butyl group, an n-amyl group, a t-amyl group, an n-hexyl group and an n-octyl group; a cycloalkyl group such as cyclohexyl group, cyclopentyl group and cyclooctyl group; an alkoxy group such as a methoxy group, an ethoxy group, a propoxy group and a butoxy group; an alkoxy-substituted alkyl group such as an ethoxy methyl group, a methoxy ethyl group, a propoxy methyl group, a butoxy ethyl group, a methoxymethoxy ethyl group, a methoxyethoxyl ethyl group and an ethoxyethoxy ethyl group; a carboxy-substituted alkyl group such as a carboxymethyl group, a 2-hydroxyethyl group and a 4-carboxybutyl group; a sulfo-substituted alkyl group such as a 3-sulfopropyl group and a 4-sulfobutyl group; a cyano-substituted alkyl group such as a 3-cyanopropyl group and a 2-cyanoethyl group; an acyl group such as a formyl group, an acetyl group and a cinnamoyl group; an acyl-substituted alkyl group such as a 3-formylpropyl group and a 4-acetylbutyl group; an alkenyloxy-substituted alkyl group such as an aryloxymethyl group and a vinyloxymethyl group; an alkenyl group such as an allyl group, a vinyl group, a pentenyl group and an octenyl group; an aryl group such as a phenyl group, a xylyl group, an ethylphenyl group, a methoxyphenyl group, a nitrophenyl group, a chlorophenyl group, a dimethylaminophenyl group and a naphthyl group; an aryl-substituted alkyl group such as a benzyl group, a p-chlorobenzyl group, a 2-phenylethyl group and a 3-phenylpropyl group; and an alkynyl group such as a propagyl group and a hexynyl group. Other examples include a substituted or unsubstituted heterocyclic group. More specifically, a thiophene ring, a pyrrolidine ring, a piperidine ring, a morpholine ring, a tetrahydropyridine ring, a cyclohexyl amine ring and the like are proposed.

More preferably, each of $R^1$ and $R^2$ is a hydrogen atom, a straight-chain or branched-chain alkyl group, or an alkoxy-substituted alkyl group.

Specific examples of $R^3$ and $R^4$ include: a straight-chain or branched-chain alkyl group, such as a methyl group, an ethyl group, an iso-propyl group, an n-propyl group, an n-butyl group, an iso-butyl group, a t-butyl group, an n-amyl group, a t-amyl group, an n-hexyl group, an n-octyl group, an n-nonyl group, an n-decyl group and an n-dodecyl group.

Preferable examples of $R^3$ and $R^4$ include: a lower alkyl group having carbon atoms of 1 to 3, for example, a methyl group, an ethyl group and a propyl group.

Specific examples of $R^5$ and $R^7$ include: a methyl group, an ethyl group and an n-propyl group.

Preferable examples of $R^5$ and $R^7$ are a methyl group and an ethyl group.

Specific examples of $R^6$ and $R^8$ include: a hydrogen atom, a methyl group, an ethyl group, an iso-propyl group, an n-propyl group, a dimethyl amino group, a diethyl amino group and a di-n-propyl amino group.

Preferable examples of $R^6$ and $R^8$ are a hydrogen atom, a dimethyl amino group and a diethyl amino group.

Specific examples of an anion $A^-$ include: a fluoride ion, a chloride ion, a bromide ion, an iodine ion, a perchlorate ion, a nitrate ion, a benzene sulfonate ion, a p-toluene sulfonate ion, a methyl sulfate ion, an ethyl sulfate ion, a propyl sulfate ion, a tetrafluoroborate ion, a tetraphenyl borate ion, a hexafluorophosphate ion, a benzene sulfinate ion, an acetate ion, a trifluoroacetate ion, a propion acetate ion, a benzoate ion, an oxalate ion, a succinate ion, a malonate ion, an oleate ion, a stearate ion, a citrate ion, a dihydrophosphate ion, a pentachlorostannate ion, a chlorosulfonate ion, a fluorosulfonate ion, a trifluoromethane sulfonate ion, a hexafluoroarsenate ion, a hexafluoroantimonate ion, a molybdate ion, a tungstate ion, a titanate ion and a zirconate ion; and preferable examples thereof include: a bromide ion, an iodine ion, a perchlorate ion, a benzene sulfonate ion, a p-toluene sulfonate ion, a methyl sulfonate ion, an ethyl sulfonate ion, a tetrafluoroborate ion, a tetraphenyl borate ion, a hexafluorphosphate ion, a benzene sulfinate ion, a propion acetate ion, a benzoate ion, a chlorosulfonate ion and a hexafluoroantimonate ion.

Preferable examples of $A^-$ are a bromide ion, an iodine ion, a perchlorate ion and a tetrafluoroborate ion.

Compound (I) is preferably a compound composed of $R^1$=$R^2$=a straight-chain or branched-chain alkyl group; $R^3$ and $R^4$=a methyl group; and $A^-$=a bromide ion, an iodine ion, a perchlorate ion or a tetrafluoroborate ion.

For example, compound (I), composed of $R^1$=$R^2$=an ethyl group; $R^3$ and $R^4$=a methyl group; and $A^-$=a tetrafluoroborate ion, has a maximum absorbing peak of 825 nm.

Compound (II) is preferably a compound composed of $R^1$=$R^2$=a straight-chain or branched-chain alkyl group; $R^3$ and $R^4$=a methyl group; and $A^-$=a bromide ion, an iodine ion, a perchlorate ion or a tetrafluoroborate ion.

Compound (III) is preferably a compound composed of $R^1$=$R^2$=an alkoxy-substituted alkyl group; and $A^-$=a bromide ion, an iodine ion, a perchlorate ion or a tetrafluoroborate ion.

For example, compound (III), composed of $R^1$=$R^2$=a methoxy ethyl group; and $A^-$=a perchlorate ion, has a maximum absorbing peak of 815 nm.

Compound (IV) is preferably a compound composed of $R^1$=$R^2$=a straight-chain or branched-chain alkyl group or an alkoxy-substituted alkyl group; and $A^-$=a bromide ion, an iodine ion, a perchlorate ion or a tetrafluoroborate ion.

For example, compound (IV), composed of $R^1$=$R^2$=an ethyl group; and $A^-$=a perchlorate ion, has a maximum absorbing peak of 830 nm.

For example, compound (IV), composed of $R^1$=$R^2$=a methoxyethoxy ethyl group; and $A^-$=an iodine ion, has a maximum absorbing peak of 830 nm.

Compound (V) is preferably a compound composed of $R^1$=$R^2$=a straight-chain or branched-chain alkyl group; $R^3$=$R^4$=a methyl group; and $A^-$=a bromide ion, an iodine ion, a perchlorate ion or a tetrafluoroborate ion.

Compound (VI) is preferably a compound composed of $R^1$=$R^2$=a hydrogen atom or a straight-chain or branched-chain alkyl group; and $A^-$=a bromide ion, an iodine ion, a perchlorate ion or a tetrafluoroborate ion.

For example, compound (VI), composed of $R^1$=$R^2$=a hydrogen atom; and $A^-$=a perchlorate ion, has a maximum absorbing peak of 825 nm.

For example, compound (VI), composed of $R^1$=$R^2$=an ethyl group; and $A^-$=an iodine ion, has a maximum absorbing peak of 817 nm.

For example, compound (VI), composed of $R^1$=$R^2$=an ethyl group; and $A^-$=a bromide ion, has a maximum absorbing peak of 818 nm.

For example, compound (VI), composed of $R^1$=$R^2$=an ethyl group; and $A^-$=a perchlorate ion, has a maximum absorbing peak of 820 nm.

Compound (VII) is preferably a compound composed of $R^5$=$R^7$=a methyl group; $R^6$=$R^8$=a hydrogen atom or a dimethyl amino group; and $A^-$=a bromide ion, an iodine ion, a perchlorate ion or a tetrafluoroborate ion. methyl group; $R^6$=$R^8$=a hydrogen atom; and $A^-$=a perchlorate ion, has a maximum absorbing peak of 833 nm.

For example, compound (VII), composed of $R^5$=$R^7$=a methyl group; $R^6$=$R^8$=a dimethyl amino group; and $A^-$=a perchlorate ion, has a maximum absorbing peak of 810 nm.

The above-mentioned cyanine-based compound can be obtained by allowing materials to undergo a condensation reaction at a temperature of 60 to 140° C. for 30 minutes to 6 hours in a solvent of alcohol, acetic acid, acetic anhydride or the like in the presence of a basic catalyst such as sodium acetate. When, for example, 5-methoxy-1-ethyl-3,3-dimethyl-2-methylene indoline and 2-chloro-1-formyl-3-hydroxymethylene cyclohexene are used as the materials, an IR absorbing agent B1, which will be described later, is obtained.

With respect to a specific example of an aminium-based compound having a maximum absorbing peak in a wavelength range of 870 to 1,000 nm, the following compound represented by formula (VIII) is proposed.

(VIII)

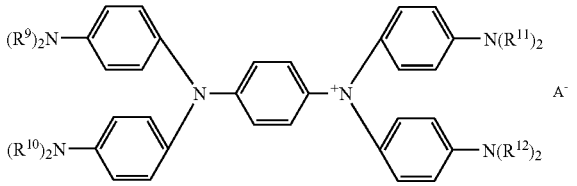

In formula (VIII), each of $R^9$ to $R^{12}$ is an unsubstituted alkyl group having a total of not more than 5 carbon atoms independently. Here, $A^-$ is the same as described above.

Specific examples of $R^9$ to $R^{12}$ include: a straight-chain or branched-chain alkyl group, such as a methyl group, an ethyl group, a propyl group, a butyl and an amyl group.

Preferable examples of $R^9$ to $R^{12}$ are an ethyl group, a propyl group and a butyl group.

Compound (VIII) is preferably a compound composed of $R^9$ to $R^{12}$=a propyl group or a butyl group; and $A^-$=a bromide ion, an iodine ion, a perchlorate ion or a tetrafluoroborate ion. For example, compound (VIII), composed of $R^9$ to $R^{12}$=a propyl group; and $A^-$=a perchlorate ion, has a maximum absorbing peak of 950 nm.

For example, compound (VIII), composed of $R^9$ to $R^{12}$=a butyl group; and $A^-$=a perchlorate ion, has a maximum absorbing peak of 950 nm.

The above-mentioned aminium-based compound may be obtained in accordance with a method disclosed in, for example, Japanese Patent Application Laid-Open No. Hei 11-315,054.

By using such an IR absorbing agent that has a sharp absorbing peak in a desired wavelength range with high sensitivity, it becomes possible to fuse even isolated toner particles on paper, and also to ensure a high fixing property, even in the case of a small amount of addition of the IR absorbing agent. With respect to the total amount of addition of the IR absorbing agent, it is preferably set to 0.01 to 2 parts by weight, more preferably 0.1 to 1 part by weight, to 100 parts by weight of the binder resin so as to provide a desirable fixing property without causing problems with the color reproducibility, charging property and costs as a full-color toner. With respect to the ratio of amounts of two kinds of IR absorbing agents, the amount of an IR absorbing agent having a maximum absorbance in a wavelength range of 800 to 870 nm and the amount of an IR absorbing agent having a maximum absorbance in a wavelength range of 870 to 1,000 nm are set to 1:4 to 4:1, more preferably 1:3 to 2:1;

this ratio is desirable in an attempt to improve the fixing property with a small amount of addition.

In the present invention, three kinds or more IR absorbing agents may be contained as long as the toner of the present invention is allowed to exert the above-mentioned absorbing characteristic.

With respect to the binder resin of the present invention, examples thereof include polyester resins, styrene-based resin and the like.

With respect to the polyester resin, a polyester resin, prepared by condensation-polymerizing a polyhydroxy alcohol component and a polycarboxylic acid component, can be applied.

Among polyhydroxy alcohol components, examples of dihydric alcohol components include: bisphenol A alkylene oxide additives, such as polyoxypropylene(2,2)-2,2-bis(4-hydroxyphenyl)propane, polyoxypropylene(3,3)-2,2-bis(4-hydroxyphenyl)propane, polyoxypropylene(6)-2,2-bis(4-hydroxyphenyl)propane, polyoxyethylene(2,0)-2,2-bis(4-hydroxyphenyl)propane, ethyleneglycol, diethyleneglycol, triethyleneglycol, 1,2-propyleneglycol, 1,3-propyleneglycol, 1,4-butanediol, neopentylglycol, 1,4-butenediol, 1,5-pentanediol, 1,6-hexanediol, 1,4-cyclohexanedimethanol, dipropyleneglycol, polyethyleneglycol, polytetramethyleneglycol, bisphenol A and hydrogenized bisphenol A.

Examples of trihydric or more alcohol components include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Among polycarboxylic acid components, examples of dihydric carboxylic acid components include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, n-dodecenyl succinic acid, isododecenyl succinic acid, n-dodecyl succinic acid, isododecyl succinic acid, n-octenyl succinic acid, isooctenyl succinic acid, n-octyl succinic acid, isooctyl succinic acid, and anhydrides of these acids or low alkyl esters.

Examples of trihydric or more carboxylic acid components include 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, empol trimer acid, anhydrides of these acids, and low alkyl esters.

In the present invention, in particular, in order to improve the fixing property, or in order to control the gloss of an image with respect to color toners requiring a light-transmitting property, it is preferable to use two kinds of polyester resins having different softening points with respect to the polyester resin. In order to improve the fixing property, it is preferable to use a first polyester resin having a softening point in a range from 90 to 120° C. and a second polyester resin having a softening point in a range from 120 to 150° C. More preferably, the softening point of the first polyester resin is set in a range from 90 to 110° C., and the softening point of the second polyester resin is set in a range from 120 to 140° C. The glass transition point of the first and second polyester resins is preferably set in a range from 50 to 75° C., more preferably from 55 to 70° C. This is because when the glass transition point is too low, the heat resistance of the toner becomes insufficient and when it is too high, the pulverizing property is deteriorated upon manufacturing the toner using a pulverizing method, resulting in low manufacturing efficiency.

With respect to the first polyester resin, a polyester resin, obtained by polycondensing the above-mentioned polyhydroxy alcohol component and polycarboxylic acid component, is preferably used; and more preferably, the polyester resin is obtained by using a bisphenol A alkylene oxide adduct as a main component serving as the polyhydroxy alcohol component, with at least one component selected from the group consisting of only terephthalic acid, fumaric acid, dodecenyl succinic acid and benzene tricarboxylic acid being used as a main component serving as the polycarboxylic acid component.

With respect to the second polyester resin, a polyester resin, obtained by polycondensing the above-mentioned polyhydroxy alcohol component and polycarboxylic acid component, is preferably used; and more preferably, the polyester resin is obtained by using a bisphenol A alkylene oxide adduct as a main component serving as the polyhydroxy alcohol component, with a trihydric or more carboxylic acid component, that is, in particular, benzene tricarboxylic acid and at least one component selected from the group consisting of terephthalic acid, fumaric acid, and dodecenyl succinic acid being used as main components serving as the polycarboxylic acid components.

The weight ratio of the first polyester resin and the second polyester resin is preferably set in a range of 9:1 to 6:4, more preferably 9:1 to 7:3.

With respect to the styrene-based resin, the resin made from the following raw-material monomer is used.

Examples of the raw-material monomer for the styrene-based resin include: styrene or styrene derivatives, such as styrene, o-methylstyrene, m-methylstyrene, p-methylstyrene, α-methylstyrene, p-ethylstyrene, 2,4-dimethylstyrene, p-tert-butylstyrene and p-chlorostyrene; ethylene unsaturated monoolefins, such as ethylene, propylene, butylene and isobutylene; methacrylic acid alkyl esters, such as methylmethacrylate, n-propylmethacrylate, isopropylmethacrylate, n-butylmethacrylate, isobutylmethacrylate, t-butylmethacrylate, n-pentylmethacrylate, isopentylmethacrylate, neopentylmethacrylate, 3-(methyl)butylmethacrylate, hexylmethacrylate, octylmethacrylate, nonylmethacrylate, decylmethacrylate, undecylmethacrylate and dodecylmethacrylate; acrylic acid alkyl esters, such as methylacrylate, n-propylacrylate, isopropylacrylate, n-butylacrylate, isobutylacrylate, t-butylacrylate, n-pentylacrylate, isopentylacrylate, neopentylacrylate, 3-(methyl)butylacrylate, hexylacrylate, octylacrylate, nonylacrylate, decylacrylate, undecylacrylate, and dodecylacrylate; unsaturated carboxylic acids, such as acrylic acid, methacrylic acid, itaconic acid and maleic acid; acrylonitrile, maleic acid ester, itaconic acid ester, vinyl chloride, vinylacetate, vinylbenzoate, vinylmethylethylketone, vinylhexylketone, vinylmethylether, vinylethylether, and vinylisobutylether. Examples of polymerization initiators used upon polymerizing the material monomers for the styrene-based resin include azo or diazo polymerization initiators such as 2,2'-azobis(2,4-dimethylvaleronitrile), 2,2'-azobis (2,4-valeronitrile), 2,2'-azobisisobutyronitrile, 1,1'-azobis(cyclohexane-1-carbonitrile) and 2,2'-azobis-4-methoxy-2,4-dimethylvaleronitrile; peroxide polymerization initiators such as benzoyl peroxide, methylethylketone peroxide, isopropylperoxycarbonate and lauroyl peroxide; and persulfate polymerization initiators such as potassium persulfate.

In addition to these, epoxy resins may be preferably used. With respect to the epoxy resin used in the present invention, a polycondensation product between bisphenol A and epichlorohydrin is preferably used. For example, Epomic R362, R364, R365, R367, R369 (made by Mitsui Chemicals Inc.), Epotot YD-011, YD-012, YD-014, YD-904, YD-017 (made by Toto Kasei Co., Ltd.) and Epi Coat 1002, 1004, 1007 (made by Shell Chemical) are commercially available.

With respect to colorants used in the present invention, known pigments and dyes may be used. Examples thereof include: carbon black, aniline blue, Chalcooil Blue, chrome yellow, ultramarine blue, DuPont Oil Red, quinoline yellow, methylene blue chloride, copper phthalocyanine, Malachite green oxalate, Lump Black, Rose Bengal, C.I. Pigment Red 48:1, C.I. Pigment Red 122, C.I. Pigment Red 57:1, C.I. Pigment Red 184, C.I. Pigment Yellow 97, C.I. Pigment Yellow 12, C.I. Pigment Yellow 17, C.I. Solvent Yellow 162, C.I. Pigment Yellow 180, C.I. Pigment Yellow 185, C.I. Pigment Blue 15:1, C.I. Pigment Blue 15:3, etc. The content of these colorants is preferably set in the range of 2 to 10 parts by weight with respect to 100 parts by weight of the binder resin.

With respect to the black toner, in addition to various carbon blacks, activated carbon and titanium black, one portion or the entire portion of the colorant may be replaced with a magnetic substance. Examples of such a magnetic substance include known magnetic fine particles such as ferrite, magnetite and iron. In an attempt to obtain an appropriate dispersion property upon manufacturing, the average particle size of the magnetic particles is preferably set to not more than 1 μm, more preferably not more than 0.5 μm.

The toner of the present invention preferably contains a release agent. With respect to the release agent, examples thereof include known waxes such as polyolefin waxes like polyethylene, polypropylene and ethylene-propylene copolymer, synthetic ester waxes like montan-based esters and fatty acid esters, carnauba wax, rice wax, sazol wax, Fischer-Tropsch wax, candelilla wax, hydrogenated jojoba oil wax, and paraffin wax; and one kind or two kinds or more of these may be selected and used.

In particular, in an attempt to further improve the fixing property and smearing preventive property, more preferably, a combination of a wax having a low-melting point of 55 to 85° C., more preferably 55 to 75° C. (hereinafter, referred to as low-melting point wax) and a polyolefin wax is used. By using these waxes in combination, a toner image is fused more quickly with comparatively small light energy, making it possible to further improve the fixing property and smearing preventive property.

With respect to the low-melting-point wax, waxes having a superior dispersing property to binder resins are preferably used, and more preferably, synthetic ester waxes are used.

The synthetic ester wax is obtained through a condensation reaction between a straight-chain saturated monocarboxylic acid and a straight-chain saturated monohydric alcohol or polyhydroxy alcohol, and among those synthetic ester waxes, those having a sharp melting property are more preferably used. By containing such a synthetic ester wax, the toner is allowed to have both of the anti-blocking property and appropriate fixing property, even when it has virtually the same melting point as the resin.

In order to obtain a synthetic ester wax having a sharp melting property, the following straight-chain saturated monocarboxylic acids, straight-chain saturated monohydric alcohols and straight-chain saturated polyhydroxy alcohols are effectively used.

With respect to the straight-chain saturated monocarboxylic acid, one kind or more of compounds selected from the group consisting of straight-chain saturated monocarboxylic acids having 14 to 30 carbon atoms are preferably used. When two kinds or more of compounds are used as the straight-chain saturated monocarboxylic acids, the amount of one component thereof is set to not less than 60 weight % with respect to the total amount of the straight-chain saturated monocarboxylic acids.

With respect to the straight-chain saturated monohydric alcohol, one kind or more of compounds selected from the group consisting of straight-chain saturated monohydric alcohols having 2 to 30 carbon atoms are preferably used. When two kinds or more of compounds are used as the straight-chain saturated monohydric alcohol, the amount of one component thereof is set to not less than 80 weight % with respect to the total amount of the straight-chain saturated monohydric alcohols.

With respect to the straight-chain saturated polyhydroxy alcohol, one kind or more of compounds selected from the group consisting of straight-chain saturated dihydric to hexahydric alcohols having 2 to 30 carbon atoms are preferably used. When two kinds or more of compounds are used as the straight-chain saturated polyhydroxy alcohol, the amount of one component thereof is set to not less than 80 weight % with respect to the total amount of the straight-chain saturated polyhydroxy alcohols.

With respect to the commercial products of the low-melting-point wax, examples thereof include Candelilla Wax Refine made by Nippon Steel Chemical Co., Ltd. (melting-point: 67° C.), Candelilla Wax H Powder made by Mitsuba Trading Co., Ltd. (melting-point: 67° C.), hydrogenated jojoba oil M1 (melting-point: 72° C.), UNILIN 350 (melting-point: 68° C.) made by Toyo Petrolite Co. Ltd., WEP-4 (melting-point: 71° C.), WEP-2 (melting-point: 71° C.) and WEP-5 (melting-point: 82° C.) made by NOF Corporation, and RIKEMAL VT-50 (melting-point: 70° C.), RIKEMAL B-150 (melting-point: 70° C.) and RIKESTER SL-02 (melting-point: 67° C.) made by Riken Vitamin Co., Ltd.

With respect to the polyolefin wax also, those waxes having a sharp melting property are preferably used so as to be sufficiently fused; and in particular, those waxes having a melting point of 80 to 150° C., more preferably 90 to 130° C. are preferably used. By containing the above-mentioned polyolefin wax, the toner is allowed to effectively exert a proper fixing performance by using a comparatively small quantity of heat, even when energy radiation to the peripheral area, which has caused a conventional problem with a non-contact heat fixing process, is comparatively great.

With respect to the polyolefin wax, for example, commercially available products are polyethylene waxes, such as 800P (made by Mitsui Chemicals Ltd.), 2203A (made by Mitsui Chemicals Ltd.), 4202E (made by Mitsui Chemicals Ltd.) and PE190 (made by Clariant K.K.), and polypropylene waxes, such as 660P (made by Sanyo Chemical Industries, Ltd.), TS-200 (made by Mitsui Chemicals Ltd.), 100TS (made by Sanyo Chemical Industries, Ltd.) and 110TS (made by Sanyo Chemical Industries, Ltd.).

In the case of adding a wax, the content thereof is preferably set to 0.5 to 5 parts by weight with respect to 100 parts by weight of the binder resin so as to obtain the effects of addition without causing problems such as filming. In the case of using two or more kinds of waxes, the total amount of these is preferably set in the above-mentioned range.

The toner of the present invention may contain additives, such as a charge-controlling agent, on demand.

With respect to the charge-controlling agent, examples thereof include metal-containing dyes such as a fluorine-based surfactant, a salicylic acid metal complex and an azo-based metal compound, a polymeric acid such as a copolymer containing maleic acid as its monomer component, quaternary ammonium salts, azine-based dyes such as Nigrosine, and carbon black.

In the toner of the present invention, the state of presence of the respective components is not particularly limited. In particular, the IR absorbing agent may be contained in the toner particles made from at least a binder resin, or may be fixed and fused on the outer surface of the toner particles. Alternatively, one portion thereof may be internally contained, with the rest portion thereof being fixed and fused on the outer surface of the toner particles. From the viewpoint of sufficiently fusing each toner particle so as to improve the fixing property, it is more preferable to contain the agent in the toner particle.

The toner of the present invention may be prepared in accordance with known methods such as a pulverizing method, an emulsion polymerization method, an emulsion polymerizing coagulation method, an emulsion dispersion method, an emulsion polymerization method and a suspension polymerization method.

In the pulverizing method, after a binder resin, a colorant and an IR absorbing agent as well as other additives have been mixed, the mixture is melt-kneaded, and cooled to obtain a kneaded matter. Then, the kneaded matter is pulverized and classified, and then subjected to a surface-modifying treatment, if necessary, to obtain a toner. Here, the IR absorbing agent may be added thereto immediately before the surface-modifying treatment.

In the emulsion polymerizing coagulation method, a polymerizable composition containing a monomer capable of forming a binder resin (for example, the above-mentioned styrene-based monomer and the like; hereinafter, referred to as "polymerizable monomer") and the like is emulsion-polymerized in an aqueous dispersion medium, and the resulting resin fine particles are coagulated and fused with at least a colorant in an emulsified state and washed and dried so that toner particles are obtained. The IR absorbing agent, a wax, a charge-controlling agent and the like may be preliminarily contained in the polymerizable composition respectively in separate manner, or may be coagulated and fused with the resin fine particles in an emulsified state together with the colorant.

In the emulsion polymerization method and the suspension polymerization method, a polymerizable composition containing a polymerizable monomer, a colorant and an IR absorbing agent as well as other additives is emulsified or suspended in an aqueous medium, and polymerized, and then washed and dried to obtain toner particles.

In the emulsion dispersing method, a binder resin, a colorant and an IR absorbing agent as well as other additives are dissolved or dispersed in an appropriate organic solvent to form a colored resin solution, and the resulting solution is added to an aqueous dispersion medium and stirred strongly to form droplets of the resin solution. Thereafter, this is heated so that the organic solvent is removed from the droplets, and the resulting solution is washed and dried to obtain toner particles.

It is preferable to add various organic/inorganic fine particles to the toner of the present invention as fluidity-adjusting agents. Examples of the inorganic fine particles include various carbides, such as silicon carbide, boron carbide, titanium carbide, zirconium carbide, hafnium carbide, vanadium carbide, tantalum carbide, niobium carbide, tungsten carbide, chromium carbide, molybdenum carbide, calcium carbide and diamond carbon lactam, various nitrides such as boron nitride, titanium nitride and zirconium nitride, bromide such as zirconium bromide, various oxides, such as titanium oxide, calcium oxide, magnesium oxide, zinc oxide, copper oxide, aluminum oxide, silica and colloidal silica, various titanic acid compounds, such as calcium titanate, magnesium titanate and strontium titanate, sulfides such as molybdenum disulfide, fluorides such as magnesium fluoride and carbon fluoride, various metal soaps, such as aluminum stearate, calcium stearate, zinc stearate and magnesium stearate, and various nonmagnetic inorganic fine particles such as talc and bentonite. These materials may be used alone or in combination. In particular, in the case of the application of inorganic fine particles such as silica, titanium oxide, alumina and zinc oxide, it is preferable to preliminarily carry out a surface treatment by a known method using a conventionally used hydrophobic-property applying agent, such as a silane coupling agent, a titanate coupling agent, silicone oil and silicone varnish, or using a treatment agent, such as a fluorine-based silane coupling agent or fluorine-based silicone oil, a coupling agent having an amino group and a quaternary ammonium salt group, and a modified silicone oil.

Figure 2:
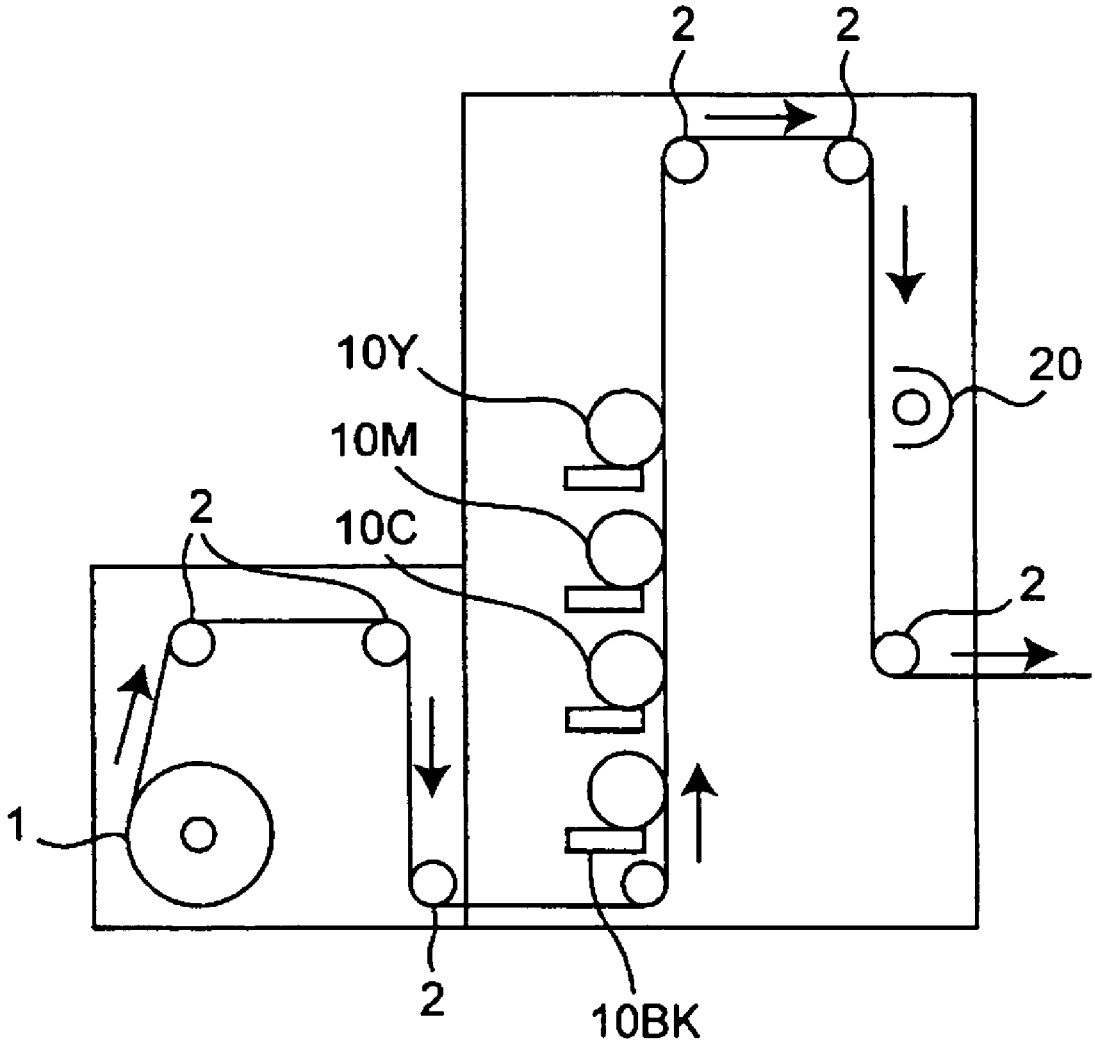
FIG. 2 is a schematic block diagram that shows a full-color image-forming apparatus having a non-contact fixing system to which the toner of the present invention is desirably applied.

Referring to an image-forming apparatus shown in FIG. 2 using the method of the present invention, the following description will discuss an image-forming method which includes a non-contact heat fixing method to which the non-contact heat-fixing color toner of the present invention is desirably applied. The apparatus of FIG. 2 adopts a flash fixing system as its fixing system; however, the fixing system of the present invention may be an oven fixing system using infrared rays.

In the full-color image-forming apparatus shown in FIG. 2, a recording medium 1, which is wound into a roll shape, is fed by respective rollers 2, and on one surface side of the recording medium 1 fed in this manner, a first image-forming unit 10Bk that supplies black toner to the recording medium 1, a second image-forming unit 10C that supplies cyan toner to the recording medium 1, a third image-forming unit 10M that supplies magenta toner to the recording medium 1 and a fourth image-forming unit 10Y that supplies yellow toner to the recording medium 1 are placed in this order from the upstream side of the recording medium 1 toward the downstream side thereof.

Thus, the first to fourth image-forming units 10Bk, 10C, 10M and 10Y supply the respective toners to appropriate places so that a full-color toner image is continuously formed on the one surface side of the recording medium 1 that is fed by the feeding rollers 2 as described above.

In this manner, the recording medium 1 on which the full-color toner image has been continuously formed on its one surface side is directed to a flash fixing device 20 provided with a flash lamp by using a feeding roller 2 so that the full-color toner image formed on the one surface side of the recording medium 1 is irradiated with light from this flash fixing device 20 in a non-contact state so that the full-color toner image is fixed on the recording medium 1 by this light energy.

For example, the flash lamp may be a xenon lamp, a halogen lamp or the like. More preferably, a flash lamp having a light-emission spectrum peak at least in a wavelength range from 810 to 840 nm, in particular, such a xenon lamp, is used.

In the case when the above-mentioned toner of the present invention is applied as toners in the first to fourth image-forming units 10Bk, 10C, 10M and 10Y, in particular, as toners in the second to fourth image-forming units 10C, 10M and 10Y, the above-mentioned flash fixing device 20 is allowed to sufficiently fix the full-color toner image without causing any problem with the smearing preventive property, even in the case of fixing the full-color toner image by superposing the respective toners on the recording medium 1.

Upon continuously forming the full-color toner image of the present invention as described above, the amount of total adhesion of the toner is preferably set to not more than 2 g/m$^2$, more preferably 0.5 to 1.5 g/m$^2$. Even in such a comparatively small amount of toner adhesion, the toner image formed by the full-color toner of the present invention can be sufficiently fixed on the recording medium 1.

Upon fixing the full-color toner image on the recording medium 1 by using the flash fixing device 20 as described above, the light-emitting energy of the flash lamp can be set in a range of 3.0 to 5.0 J/cm$^2$. Even with such low energy, the toner image formed by the full-color toner of the present invention can be sufficiently fixed on the recording medium 1.

EXAMPLES

Production Example of Polyester Resin

To a four-necked flask provided with a thermometer, a stainless stirring stick, a dropping-type condenser and a nitrogen gas directing tube were loaded an alcohol component and an acid component, which were adjusted to a mole ratio as shown in Table 1, together with a polymerization initiator (dibutyltinoxide). This was allowed to react in a mantle heater by heating at 220° C. while being stirred under a nitrogen gas flow. Here, the progress of the reaction was followed by measuring its acid value. At the time of reaching a predetermined acid value, the reaction was completed, and this was cooled to room temperature; thus, polyester resins H1, L and H2 were obtained. Each of polyester resins was coarsely pulverized into not more than 1 mm, and was used to manufacture toners shown below. The resulting polyester resins have physical properties, that is, glass transition temperature (Tg), softening point (Tm), acid value, hydroxyl value and THF insoluble components, shown in Table 1.

TABLE 1

| | Alcohol component | | Acid component | | | | Physical properties | | | | |
|---|---|---|---|---|---|---|---|---|---|---|---|
| | BPA-PO | BPA-EO | TPA | TMA | DSA | FA | Tg (° C.) | Tm (° C.) | Acid value (KOHmg/g) | Hydroxyl value (KOHmg/g) | THF Insoluble components (%) |
| Resin L | 570 | 330 | 100 | 0 | 0 | 100 | 60.1 | 99.2 | 15.9 | 22.2 | — |
| Resin H1 | 350 | 400 | 150 | 100 | 50 | 50 | 65.1 | 135.3 | 14.6 | 15.6 | 18.1 |
| Resin H2 | 900 | 50 | 50 | 0 | 0 | 0 | 64.2 | 106.8 | 30.6 | 20.5 | — |

In this Table, BPA-PO represents polyoxypropylene (2,2)-2,2-bis(4-hydroxyphenyl) propane, BPA-EO represents polyoxyethylene (2,0)-2,2-bis(4-hydroxyphenyl) propane, TPA represents terephthalic acid, TMA represents trimellitic acid, DSA represents isododecenyl succinic anhydride and FA represents fumaric acid.

In the following examples, a material prepared by mixing resin H1 and resin L at a weight ratio of 2:8 was used as polyester resin A1. The Tg of polyester resin A1 was 62° C.

A material prepared by mixing resin H2 and resin L at a weight ratio of 2:8 was used as polyester resin A2. The Tg of polyester resin A2 was 60° C.

Production Example of IR Absorbing Agent

IR Absorbing Agent B1 (Cyanine Compound)

To a solvent of 10 parts of acetic anhydride were added 2 parts of 5-methoxy-1-ethyl-3,3-dimethyl-2-methylene indoline (formula (b1)), 1 part of 2-chloro-1-formyl-3-hydroxymethylenecyclohexene (formula (b2)), 1 part of tetrafluoro boric acid and 0.5 parts of sodium acetic anhydride, and after having been boiled for 1 hour, this was cooled to room temperature, and the reaction solution was suction-filtered. The reaction solution was put into 30 parts of water with ice, and the precipitated crystal was suction-filtered. The crystal was washed with 20 parts of methanol, and dried to obtain an IR absorbing agent B1. The maximum absorbing peak of this IR absorbing agent was located at 825 nm.

(b1)

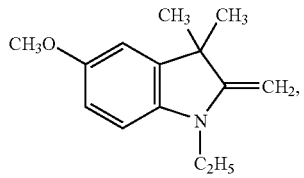

(b2)

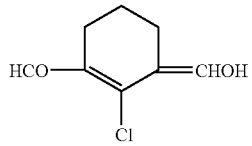

IR Absorbing Agent B2

The same processes as those in the production method of IR absorbing agent B1 were carried out except that a compound of formula (b3) was used in place of the compound of formula (b1) and a compound of formula (b4) was used in place of the compound of formula (b2), with perchloric acid being used in place of tetrafluoro boric acid, so that an IR absorbing agent B2 was obtained. The maximum absorbing peak of this IR absorbing agent was located at 825 nm.

(b3)

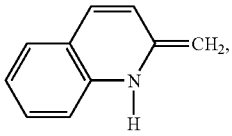

(b4)

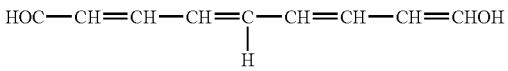

IR Absorbing Agent B3

The same processes as those in the production method of IR absorbing agent B1 were carried out except that a compound of formula (b5) was used in place of the compound of formula (b1) and a compound of formula (b6) was used in place of the compound of formula (b2), with perchloric acid being used in place of tetrafluoro boric acid, so that an IR absorbing agent B3 was obtained. The maximum absorbing peak of this IR absorbing agent was located at 830 nm.

(b5)

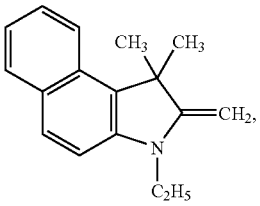

(b6)

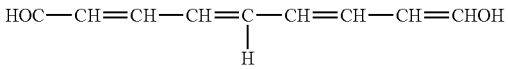

IR Absorbing Agent B4

The same processes as those in the production method of IR absorbing agent B1 were carried out except that a compound of formula (b7) was used in place of the compound of formula (b1) and a compound of formula (b8) was used in place of the compound of formula (b2), with tetrafluoro antimonic acid being used in place of tetrafluoro boric acid, so that an IR absorbing agent B4 was obtained. The maximum absorbing peak of this IR absorbing agent was located at 780 nm.

(b7)

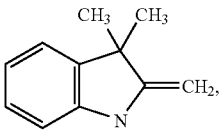

(b8)

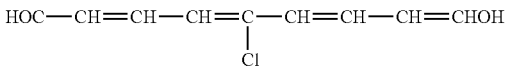

IR Absorbing Agent B5

The same processes as those in the production method of IR absorbing agent B1-were carried out except that a compound of formula (b9) was used in place of the compound of formula (b1) and a compound of formula (b10) was used in place of the compound of formula (b2), with perchloric acid being used in place of tetrafluoro boric acid, so that an IR absorbing agent B5 was obtained. The maximum absorbing peak of this IR absorbing agent was located at 760 nm.

(b9)

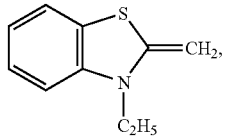

(b10)

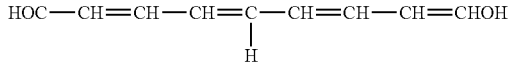

IR Absorbing Agent B6 (Polymethine Compound)

The same processes as those in the production method of IR absorbing agent B1 were carried out except that a compound of formula (b11) was used in place of the compound of formula (b1) and a compound of formula (b12) was used in place of the compound of formula (b2), with iodine being used in place of tetrafluoro boric acid, so that an IR absorbing agent B6 was obtained. The maximum absorbing peak of this IR absorbing agent was located at 760 nm.

(b11)

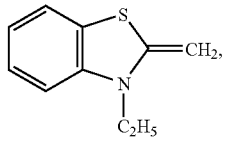

(b12)

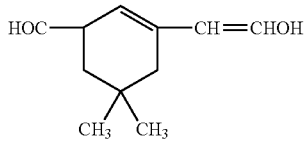

IR Absorbing Agent B7 (Diimmonium Compound)

The same processes as those in the production method of IR absorbing agent C1 described below were carried out except that 0.44 g of sodium perchlorate was used so that an IR absorbing agent B7 was obtained. The maximum absorbing peak of this IR absorbing agent was located at 1060 nm.

IR Absorbing Agent C1 (Aminium Compound)

To ethyl acetate was dissolved 1.38 g of N,N,N',N'-tetracis(p-dibutylaminophenyl)-p-penylenediamine, and to this was added a solution prepared by dissolving 6 ml of acetonitrile, 0.22 g of sodium perchlorate and 1.13 g of ammonium salt of ferric complex salt of 1,3-diaminopropane tetraacetate in 6 ml of water. This was stirred for 6 hours at 30° C. The reaction mixture was washed with water, and condensed under reduced pressure, and to this was added n-heptane so that the deposited crystal was filtered and dried to obtain green powder. The maximum absorbing peak of this IR absorbing agent was located at 950 nm.

IR Absorbing Agent C2

The same processes as those in the production method of IR absorbing agent C1 were carried out except that N,N,N',N'-tetracis(p-dipropylaminophenyl)-p-penylenediamine was used in place of N,N,N',N'-tetracis(p-dibutylaminophenyl)-p-penylenediamine so that an IR absorbing agent C2 was obtained. The maximum absorbing peak of this IR absorbing agent was located at 950 nm.

IR absorbing agent (B1)

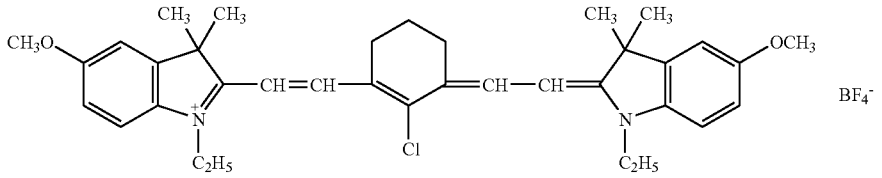

IR absorbing agent (B2)

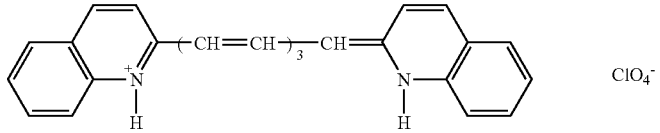

IR absorbing agent (B3)

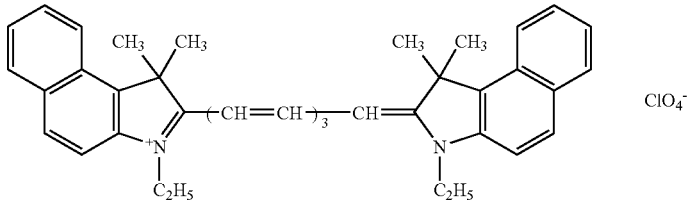

IR absorbing agent (B4)

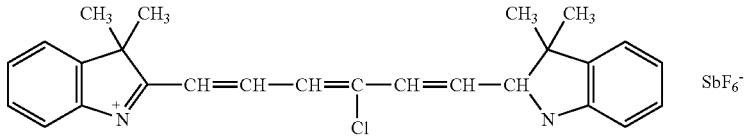

IR absorbing agent (B5)

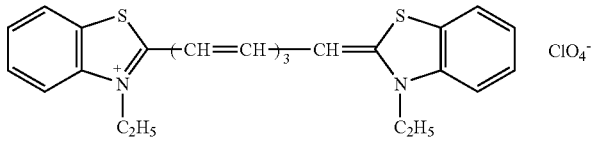

IR absorbing agent (B6)

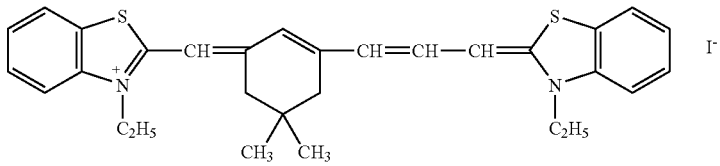

IR absorbing agent (B7)

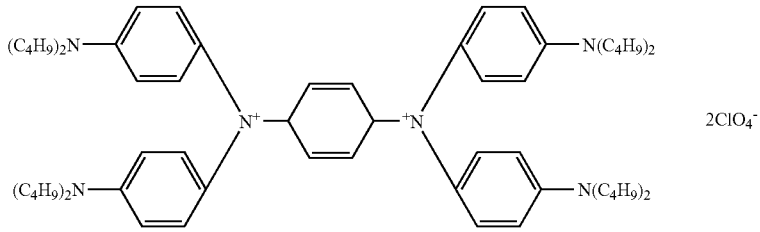

-continued

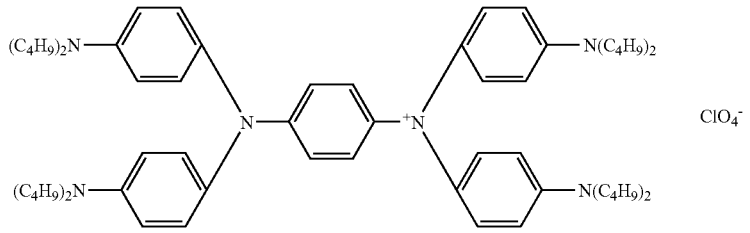

IR absorbing agent (C1)

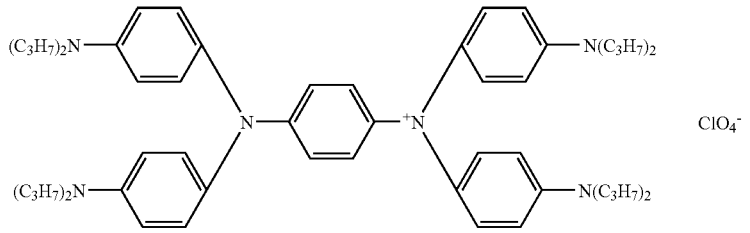

IR absorbing agent (C2)

Production Example of Release Agent

Wax D1 (Ester Wax)

To a four-necked flask were added 100 g of glycerin (about 1 mole) serving as alcohol and 900 g of stearic acid (about 3 moles) serving as carboxylic acid, and this was allowed to react at normal pressure for 15 hours under a nitrogen gas flow while distilling the reaction water off at 220° C. The amount of the resulting esterified coarse product was approximately 850 g. To 850 g of the esterified coarse product were added 190 g of toluene and 90 g of ethanol (20 parts by weight of hydrocarbon solvent and 10 parts by weight of separation-use alcohol solvent with respect to 100 parts by weight of the esterified coarse product), and to this was further added a 10% aqueous solution of potassium hydroxide and stirred for 30 minutes at 70° C. Thereafter, this was allowed to stand still for 30 minutes and the water-layer portion was removed to complete the deoxidizing process. Next, 20 parts by weight of ion exchange water was added to 100 parts by weight of the esterified coarse product thus used, and after having been stirred for 30 minutes at 70° C., this was allowed to stand still for 30 minutes so that the water layer portion was separated and removed. Washing processes were repeated until the pH of the waste water had become neutral, and with respect to the remaining ester layer, the solvent was distilled off at 180° C. under reduced pressure of 1 kPa, and filtered to obtain an ester wax having a melting point of 62° C.

Wax D2 (Ester Wax)

The same processes as those in the manufacturing method of wax D1 were carried out except that 100 g of pentaerythritol was used as the alcohol component and that 1,050 g of behenic acid was used as the carboxylic acid component to obtain wax D2 having a melting point of 84° C.

Wax E1 (Polyethylene Wax)

A commercially available low-molecular-weight polyethylene wax (800P: melting point 125° C., made by Mitsui Chemicals Ltd.) was used.

Wax E2 (Polyolefin Copolymer Wax)

To a reactor were measured and charged 1,000 g of propane, 250 g of propene, 0.5 bar of hydrogen and 7 bar of ethylene at 30° C. Simultaneously with these processes, in order to prepare a catalyst, 10 mg of bis-n-butylcyclopentadienyl zirconium dichloride was dissolved in a methylaminohexane solution having a concentration of 10% by weight in 5 $cm^3$ of toluene, and this was allowed to stand still for 15 minutes to be preliminarily activated. This reactor was heated to 70° C., and stirred at 100 rpm. After a lapse of 20 minutes, the catalyst that had been preliminarily activated was added through a pressure controllable valve so that a polymerizing process was initiated at 250 rpm. This was cooled so that the polymerization temperature was adjusted to 70° C., and components were measured and further added thereto so that the composition in the gaseous phase was maintained constant. After one hour of the polymerization time, isopropanol was added thereto to stop the reaction, and the reactor was released to air. The resulting product was pressure-reduced and dried to obtain an ethylene-propylene copolymer having a melting point of 105° C.

Production of Pigment Master Batch

Each pigment is dispersed in a binder resin and used as a pigment master batch. The binder resin, used in each of examples or comparative examples, and a pigment, such as magenta (M) pigment (C.I. Pigment Red 57-1; made by Fuji Shikiso K.K.), cyan (C) pigment (C.I. Pigment Blue 15-3; made by Dainippon Ink & Chemicals Inc.) or yellow (Y) pigment (C.I. Pigment Yellow 180; made by Clariant K.K.), were loaded into a pressure kneader at a specific weight ratio, and kneaded for 1 hour at 120° C. After having been cooled, this was coarsely pulverized with a hammer mill to obtain a pigment master batch. The weight ratio between the binder resin and the pigment was set to 7:3 in the case of magenta pigment, 7:3 in the case of cyan pigment and also 7:3 in the case of yellow pigment.

Production of Full-color Toner

Examples 1 to 16 and Comparative Examples 1 to 6

Pulverizing Method

Binder resin A, IR absorbing agent B, IR absorbing agent C, wax D and release agent E, shown in Tables 2 and 3, were used at respective amounts shown in Tables 2 and 3, and master batch virtually containing 4.0 parts by weight of M pigment, master batch virtually containing 5.0 parts by weight of C pigment or master batch virtually containing 7.0 parts by weight of Y pigment was used. After a mixture of these had been sufficiently mixed by a Henschel mixer, the resulting mixture was melt-kneaded by using a twin-screw extruder kneader (PCM-63 made by Ikegai Ltd.). The resulting kneaded matter was rolled by a cooling press, and cooled off by using a cooling belt, and then coarsely pulverized by a feather mill. Thereafter, the resulting matter was pulverized by using a mechanical pulverizing device (KTM: made by Kawasaki Heavy Industries Ltd.) to an average particle size of 10 to 12 μm, and further pulverized and coarsely classified by a jet mill (IDS: made by Nippon Pneumatic Mfg. Co., Ltd.) to an average particle size of 7 μm, and then finely pulverized and classified by a rotor-type classifier (Teeplex-type classifier 100ATP: made by Hosokawamicron Corp.) to obtain toner particles having a volume-average particle size of 7.5 μm.

To 100 parts by weight of these toner particles were added 0.5 parts by weight of hydrophobic silica fine particles (H-2,000: made by Wacker Co., Ltd.), 0.5 parts by weight of titanium oxide (STT30A: made by Titan Kogyo K.K.) and 1.0 part by weight of strontium titanate having an average particle size of 0.2 μm, and the mixture of these was mixed by a Henschel mixer at a peripheral speed of 40 m/sec for 5 minutes, and then filtered through a sieve of 106 μm mesh to obtain a toner.

Example 17

Emulsion Polymerization Method

To 10.0 Kg of pure water was put 0.90 kg of sodium n-dodecyl sulfate, and stirred and dissolved. To this solution were gradually added 1.20 kg of C.I. Pigment Red 57-1 (made by Fuji Shikiso K.K.), 0.1 kg of IR absorbing agent B1 and 0.1 kg of IR absorbing agent C, and after having been stirred sufficiently for one hour, this was continuously dispersed for 20 hours by using a sand grinder (medium-type disperser). This solution was prepared as "colorant dispersion solution 1."

A solution made from 0.055 kg of sodium dodecylbenzene sulfonate and 4.0 L of ion exchange water was prepared as "anionic surfactant solution A."

A solution made from 0.014 kg of nonylphenol polyethylene oxide 10-mol adduct and 4.0 L of ion exchange water was prepared as "nonionic surfactant solution B." A solution formed by dissolving 223.8 g of potassium persulfate in 12.0 L of ion exchange water was prepared as "initiator solution C."

To a 100-L GL (glass lining) reactor equipped with a temperature sensor, a cooling tube and a nitrogen introducing device were loaded 3.41 kg of WAX emulsion (polypropylene emulsion having a number-average molecular weight of 3,000: number-average primary particle size=120 nm/solid concentration=29.9%), all the amount of "anionic surfactant solution A" and all the amount of "nonionic surfactant solution B", and the stirring process thereof was started. Next, to this was added 44.0 L of ion exchange water. The heating process was started, and when the temperature of the solution had reached 75° C., all the amount of "initiator solution C" was dripped thereto. Thereafter, while the temperature of the solution was controlled within 75° C.±1° C., to this were added 12.1 kg of styrene, 2.88 kg of n-butyl acrylate, 1.04 kg of methacrylic acid and 548 g of t-dodecyl mercaptan while being dripped. Upon completion of the dripping process, the temperature of the solution was raised to 80° C.±1° C., and this was heated and stirred for 6 hours. Next, the solution was cooled to not more than 40° C. at which the stirring process was stopped, and filtered through a pole filter; thus, the resulting matter was prepared as "latex A." Here, the resin particle in latex A had a glass transition temperature of 57° C. and a softening point of 121° C., and with respect to the molecular weight distribution, it had a weight average molecular weight=12700, with a weight-average particle size of 120 nm.

A solution formed by dissolving 0.055 kg of sodium dodecylbenzene sulfonate in 4.0 L of ion exchange water was prepared as "anionic surfactant solution D." A solution formed by dissolving 0.014 kg of nonylphenol polyethylene oxide 10-mole adduct in 4.0 L of ion exchange water was prepared as "nonionic surfactant solution E." A solution formed by dissolving 200.7 g of potassium persulfate (made by KANTO KAGAKU) in 12.0 L of ion exchange water was prepared as "initiator solution F."

To a 100-L GL reactor equipped with a temperature sensor, a cooling tube, a nitrogen introducing device and a comb-shaped baffle were loaded 3.41 kg of WAX emulsion (polypropylene emulsion having a number-average molecular weight of 3,000: number-average primary particle size=120 nm/solid concentration=29.9%), all the amount of "anionic surfactant solution D" and all the amount of "nonionic surfactant solution E", and the stirring process thereof was started. Next, to this was added 44.0 L of ion exchange water. The heating process was started, and when the temperature of the solution had reached 70° C., "initiator solution F" was added thereto. Then, a solution, preliminarily prepared by mixing 11.0 kg of styrene, 4.00 kg of n-butyl acrylate, 1.04 kg of methacrylic acid and 9.02 kg of t-dodecyl mercaptan, was dripped thereto. After completion of the dripping process, while the temperature of the solution was controlled within 72° C.±2° C., the solution was heated and stirred for 6 hours. The temperature of the solution was raised to 80° C.±2° C., and the solution was heated and stirred for 12 hours. Next, the solution was cooled to not more than 40° C., and the stirring process was stopped. The resulting solution was filtered through a pole filter; thus, the filtrate was prepared as "latex B." Here, the resin particle in latex B had a glass transition temperature of 58° C. and a softening point of 132° C., and with respect to the molecular weight distribution, it had a weight-average molecular weight=245,000, with a weight-average particle size of 110 nm.

A solution formed by dissolving 5.36 kg of sodium chloride serving as a salting-out agent in 20.0 L of ion exchange water was prepared as "sodium chloride solution G." A solution formed by dissolving 1.00 g of fluorine-based nonionic surfactant in 1.00 L of ion exchange water was prepared as "nonionic surfactant solution H."

To a 100-L SUS reactor equipped with a temperature sensor, a cooling tube, a nitrogen-introducing device and a monitoring device for particle size and shape were loaded 20.0 kg of latex A, 5.2 kg of latex B and 0.4 kg of colorant dispersion solution 1, prepared as described above, together with 20.0 kg of ion exchange water, and stirred. Next, this was heated to 40° C., and to this were successively added sodium chloride solution G, 6.00 kg of isopropanol (made by KANTO KAGAKU) and nonionic surfactant solution H in this order. After this had been left for 10 minutes, the heating process was started so that the solution was heated to 85° C. in 60 minutes, and heated and stirred for 0.5 to 3 hours at 85° C.±2° C.; thus, the particle size was allowed to grow while being subjected to salting-out/fusing processes. Next, to this was added 2.1 L of pure water to stop the growth of the particle size.

To a 5-L reactor equipped with a temperature sensor, a cooling tube and a monitoring device for particle size and shape was loaded 5.0 kg of the dispersion solution with the fused particles prepared as described above, and this was heated and stirred for 0.5 to 15 hours at a solution temperature of 85° C.±2° C. so that a shape-controlling process was carried out. Then, the solution was cooled to not more than 40° C., and the stirring process was stopped. Next, a classifying process was carried out in the solution through a centrifugal precipitation method by using a centrifugal separator, and the solution was filtered through a sieve of 45 μm mesh; thus, this filtrate was prepared as association solution 1. Next, non-spherical particles in a wet-cake state were filtered and obtained from association solution 1 by using a nutshe. Thereafter, these non-spherical particles were washed with ion exchange water.

The non-spherical particles were dried at an air-suction temperature of 60° C. by using a flash-jet dryer, and further dried at 60° C. by using a fluidized bed drying machine. To 100 parts by weight of these colored particles were added 0.5 parts by weight of hydrophobic silica fine particles (H-2,000: made by Wacker Co., Ltd.), 0.5 parts by weight of titanium oxide (STT30A: made by Titan Kogyo K.K.) and 1.0 part by weight of strontium titanate having an average particle size of 0.2 μm, and the mixture of these was mixed by a Henschel mixer at a peripheral speed of 40 m/sec for 5 minutes, and then filtered through a sieve of 106 μm mesh to obtain a toner.

Example 18

Suspension Polymerization Method

Styrene (165 g), n-butyl acrylate (35 g), C.I. Pigment Red 57-1 (10 g)(made by Fuji Shikiso K.K.), IR absorbing agent B1 (1 g), di-t-butyl salicylic acid metal compound (2 g), styrene-methacrylic acid copolymer (8 g) and paraffin wax (20 g) (mp=70° C.) were heated to 60° C., and dissolved and dispersed evenly by a TK homomixer (made by TOKUSYU KIKA KOGYO CO., LTD.) at 12,000 rpm. This was used as a polymerization initiator, and to this was added and dissolved 10 g of 2,2'-azobis(2,4-valeronitrile) so that a polymerizable monomer composition was prepared. Next, to 710 g of ion exchange water was added 450 g of an aqueous solution of 0.1 M sodium phosphate, and to this was gradually added 68 g of 1.0 M calcium chloride while being stirred by a TK homomixer at 13,000 rpm to prepare a suspension in which tricalcium phosphate was dispersed. The above-mentioned polymerizable monomer composition was added to this suspension, and stirred by a TK homomixer at 10,000 rpm for 20 minutes to granulate the polymerizable monomer composition. Thereafter, this was allowed to react in a reaction device at 75 to 95° C. for 5 to 15 hours. Tricalcium phosphate was dissolved and removed by hydrochloric acid and a classifying process was carried out in the solution through a centrifugal precipitation method by using a centrifugal separator, and the resulting solution was filtered, washed and dried. To 100 parts by weight of the resulting colored particles were added 0.5 parts by weight of hydrophobic silica fine particles (H-2,000: made by Wacker Co., Ltd.), 0.5 parts by weight of titanium oxide (STT30A: made by Titan Kogyo K.K.) and 1.0 part by weight of strontium titanate having an average particle size of 0.2 μm, and the mixture of these was mixed by a Henschel mixer at a peripheral speed of 40 m/sec for 5 minutes, and then filtered through a sieve of 106 μm mesh to obtain a toner.

TABLE 2

| | Bulk composition | | | | | | | | | | | |
|---|---|---|---|---|---|---|---|---|---|---|---|---|
| | Binder resin A | | IR absorbing agent B | | IR absorbing agent C | | Release agent D | | Release agent E | | | |
| | Kind | Parts by weight | Kind | Parts by weight | Kind | Parts by weight | Kind | Parts by weight | Kind | Parts by weight | Color | Carrier |
| Example 1 | A1 | 100 | B1 | 0.3 | C1 | 0.3 | D1 | 2.5 | E1 | 0.5 | M | F1 |
| Example 2 | A1 | 100 | B1 | 0.15 | C1 | 0.15 | D1 | 2.5 | E1 | 0.5 | M | F1 |
| Example 3 | A1 | 100 | B1 | 0.5 | C1 | 0.5 | D1 | 2.5 | E1 | 0.5 | M | F1 |
| Example 4 | A1 | 100 | B1 | 0.5 | C1 | 0.3 | D1 | 2.5 | E1 | 0.5 | M | F1 |
| Example 5 | A1 | 100 | B1 | 0.3 | C1 | 0.5 | D1 | 2.5 | E1 | 0.5 | M | F1 |
| Example 6 | A1 | 100 | B1 | 0.15 | C1 | 0.5 | D1 | 2.5 | E1 | 0.5 | M | F1 |
| Example 7 | A2 | 100 | B1 | 0.3 | C1 | 0.3 | D1 | 2.5 | E1 | 0.5 | M | F1 |
| Example 8 | A1 | 100 | B1 | 0.3 | C1 | 0.3 | D1 | 1.5 | E1 | 0.5 | M | F1 |
| Example 9 | A1 | 100 | B1 | 0.3 | C1 | 0.3 | D1 | 2.5 | E1 | 0.5 | M | F2 |
| Example 10 | A1 | 100 | B1 | 0.3 | C1 | 0.3 | D1 | 2.5 | E1 | 0.5 | C | F1 |
| Example 11 | A1 | 100 | B1 | 0.3 | C1 | 0.3 | D1 | 2.5 | E1 | 0.5 | Y | F1 |
| Example 12 | A1 | 100 | B2 | 0.3 | C1 | 0.3 | D1 | 2.5 | E1 | 0.5 | M | F1 |
| Example 13 | A1 | 100 | B3 | 0.3 | C1 | 0.3 | D1 | 2.5 | E1 | 0.5 | M | F1 |
| Example 14 | A1 | 100 | B1 | 0.3 | C2 | 0.3 | D1 | 2.5 | E1 | 0.5 | M | F1 |
| Example 15 | A1 | 100 | B1 | 0.3 | C1 | 0.3 | D2 | 2.5 | E1 | 0.5 | M | F1 |
| Example 16 | A1 | 100 | B1 | 0.3 | C1 | 0.3 | D1 | 2.5 | E2 | 0.5 | M | F1 |
| Example 17 | A1 | 100 | B1 | 0.3 | C1 | 0.3 | D1 | 2.5 | E1 | 0.5 | M | F1 |
| Example 18 | A1 | 100 | B1 | 0.3 | C1 | 0.3 | D1 | 2.5 | E1 | 0.5 | M | F1 |

TABLE 2-continued

| | Bulk composition | | | | | | | | | | | |
|---|---|---|---|---|---|---|---|---|---|---|---|---|
| | Binder resin A | | IR absorbing agent B | | IR absorbing agent C | | Release agent D | | Release agent E | | | |
| | Kind | Parts by weight | Kind | Parts by weight | Kind | Parts by weight | Kind | Parts by weight | Kind | Parts by weight | Color | Carrier |

Example 17: Toner prepared by emulsion polymerization method
Example 18: Toner prepared by suspension polymerization method

TABLE 3

| | Bulk composition | | | | | | | | | | | |
|---|---|---|---|---|---|---|---|---|---|---|---|---|
| | Binder resin A | | IR absorbing agent B | | IR absorbing agent C | | Release agent D | | Release agent E | | | |
| | Kind | Parts by weight | Kind | Parts by weight | Kind | Parts by weight | Kind | Parts by weight | Kind | Parts by weight | Color | Carrier |
| Comparative Example 1 | A1 | 100 | — | — | C1 | 0.3 | D1 | 2.5 | E1 | 0.5 | M | F1 |
| Comparative Example 2 | A1 | 100 | B4 | 0.3 | — | — | D1 | 2.5 | E1 | 0.5 | M | F1 |
| Comparative Example 3 | A1 | 100 | B4 | 0.3 | C1 | 0.3 | D1 | 2.5 | E1 | 0.5 | M | F1 |
| Comparative Example 4 | A1 | 100 | B5 | 0.3 | C1 | 0.3 | D1 | 2.5 | E1 | 0.5 | M | F1 |
| Comparative Example 5 | A1 | 100 | B6 | 0.3 | C1 | 0.3 | D1 | 2.5 | E1 | 0.5 | M | F1 |
| Comparative Example 6 | A1 | 100 | B7 | 0.3 | C1 | 0.3 | D1 | 2.5 | E1 | 0.5 | M | F1 |

Light-absorbing Characteristic

The absorbing curve of the toner was measured. Here, in the case of measuring the absorbing curve of only the IR absorbing agent also, the same method as the toner was used.

The toner was dissolved in chloroform to prepare a solution having a 1 g/L concentration. With respect to the solution, absorbing spectra ranging from 600 to 1,100 nm were measured by a spectrophotometer (model U-4,100 manufactured by Hitachi, Ltd.), and the absorbing curve was formed.

Based upon the absorbing curve, the position of the maximum absorbing peak was read in the case of the IR absorbing agent, and the position of the maximum absorbing peak, the maximum absorbance in a range of 810 to 870 nm, and the maximum absorbance in a range of 870 to 1,000 nm were read in the case of the toner.

Production of Black Toner

Upon manufacturing black toner Bk, to 100 parts by weight of polyester resin A1 were added 8 parts by weight of carbon black (Mogul L; made by Cabot K.K.) and 1 part by weight of salicylic acid boron complex (LR151: made by JAPAN CARLIT CO., LTD.) serving as a charge-controlling agent, and the resulting mixture was melt-kneaded by using a twin-screw extruder kneader (PCM-30 made by Ikegai Ltd.), and the resulting kneaded matter was rolled by a press roller into a thickness of 2 mm, and after having been cooled by a cooling belt, this was coarsely pulverized by a feather mill. Thereafter, the resulting matter was pulverized by using a mechanical pulverizing device (KTM: made by Kawasaki Heavy Industries Ltd.), and further pulverized by a jet mill (IDS: made by Nippon Pneumatic Mfg. Co., Ltd.), and this was then classified by a rotor-type classifier (Teeplex-type classifier 100ATP: made by Hosokawamicron Corp.) to obtain black toner particles having a volume-average particle size of 7.2 μm. To 100 parts by weight of these toner particles were added 0.5 parts by weight of hydrophobic silica (H-2,000: made by Wacker Co., Ltd.), 0.5 parts by weight of titanium oxide (STT30A: made by Titan Kogyo K.K.) and 1.0 part by weight of strontium titanate having an average particle size of 0.2 μm, and the mixture of these was mixed by a Henschel mixer at a peripheral speed of 40 m/sec for 60 seconds, and then filtered through a sieve of 90 μm mesh to obtain a black toner Bk.

Production of Carrier

Carrier F1 (Production of Coat-type Carrier)

To 400 ml of methylethyl ketone was dissolved 20 parts by weight of acryl-modified silicone resin KR9706 (made by Shin-Etsu Chemical Co., Ltd.) to prepare a coating solution. This coating solution was sprayed on Cu—Zn-based ferrite particles having an average particle size of 50 μm by using a spiller coater (made by Okadaseiko Co., LTD.) to form a resin coat, and heated to 180° C. for 30 minutes so as to cure the coated resin; thus, a carrier coated with the acryl-modified silicone resin was prepared. The carrier bulk was taken out, pulverized by a grinder, classified through a sieve of 90 μm mesh, and this was further subjected to a magnetic-force classification to remove a low-magnetic-force component; thus, a resin-coated ferrite carrier having an average particle size of 50 μm was prepared.

Carrier F2 (Production of Binder-Type Carrier)

Polyester resin (100 parts by weight) (NE-110: made by Kao Corporation), 700 parts by weight of magnetic particles (Magnetite; EPT-1,000: made by Toda Kogyo Corp.) and 2 part by weight of carbon black (MOGUL-L; made by Cabot K.K.) were sufficiently mixed by a Henschel mixer, and melt-kneaded by a twin screw extruder kneader which was set at 180° C. in the cylinder section and at 170° C. in the cylinder head section. Then, this kneaded matter was cooled off, coarsely pulverized by a hammer mill, and finely pulverized by a jet mill, and then classified to obtain carrier particles having a volume-average particle size of 40 μm.

Evaluation

Each of the color toners of examples and comparative examples was mixed with each of carriers shown in Tables 2 and 3 so as to have a specific toner mixing ratio, and mixed at a frame for 30 minutes to form a starter. In the case of using carrier F1, the toner mixing ratio was 5 weight %, and in the case of using carrier F2, it was 7 weight %. With respect to the black toner, a black starter was prepared in the same method as the method for preparing the above-mentioned starter except that the toner mixing ratio with carrier F2 was set to 7 weight %.

The starter was loaded into a full-color image-forming apparatus having a non-contact fixing system, shown in FIG. 2, and mono-color images were formed. The starter was supplied to each of the image-forming units containing toners of the respective colors, and the toner amount of adhesion on the paper was 1 g/m$^2$. The fixing power of the non-contact fixing system (xenon lamp) was set to 3.5 J/cm$^2$. The xenon lamp has a light-emitting spectrum peak in a wavelength range of 810 to 840 nm.

Fixing Property

The fixing property was evaluated based upon a change in image densities obtained before and after the image had been rubbed with a sand-containing rubber eraser.

Change in image densities=(Image density after test/Image density before test)×100 (%)

◎: Change in image densities was not less than 90%;

○: Change in image densities was not less than 80%;

Δ: Change in image densities was not less than 70% (level causing no problems in practical use); and ×: Change in image densities was less than 70%.

Smearing Preventive Property

Each image, obtained at the time of evaluating the fixing property, was rubbed against another unused copying paper, and the stained state of the unused copy paper was observed, and classified into the following ranks:

◎: No stains were found;

○: Although stains were slightly found, they were hardly conspicuous;

Δ: Although stains were slightly observed, no problems were raised in practical use (level causing no problem in practical use); and ×: Stains were observed over the entire paper.

Color Reproducibility

Single color toner images were formed with a toner amount of adhesion of 5 g/m$^2$; and the level with good color reproducibility was indicated by ○; the level that causes no problem in practical use although there was slight cloud in the color was indicated by Δ; and the level that causes serious problems in practical use due to much cloud in the color was indicated by ×.

Fogging, Dot Reproducibility, Fine-line Reproducibility

The level with superior image quality was indicated by ○; the level that causes no problem in practical use was indicated by Δ; and the level that causes serious problems in practical use was indicated by ×.

Heat Resistance

Toner (20 g) was put into a glass bottle, and left under a high temperature of 50° C. for 24 hours, and the resulting toner was visually observed. The level having no aggregated particles without causing any problem was indicated by ○; the level in which soft aggregation was slightly observed, but easily crumbled, was indicated by Δ; and the level in which firm aggregation of solidified particles was observed, and hardly crumbled to cause serious problems in practical use was indicated by ×.

TABLE 4

| | Physical properties of toner (reference) | | | | | | Evaluation results | | | | | | |
|---|---|---|---|---|---|---|---|---|---|---|---|---|---|
| | Maximum absorbance (810~870) | Maximum absorbance (870~1000) | Ratio | | Maximum absorbing peak (nm) | | Fixing properties | Smearing preventive property | Color reproducibility | Fogging | Dot reproductibility | Fine-line reproductibility | Heat resistance |
| Ex. 1 | 1.10 | 0.24 | 4.6 | ○ | 825 | ○ | ○ | ◎ | ○ | ○ | ○ | ○ | ○ |
| Ex. 2 | 0.65 | 0.20 | 3.3 | ○ | 825 | ○ | Δ | ○ | ○ | ○ | ○ | ○ | ○ |
| Ex. 3 | 1.60 | 0.28 | 5.7 | ○ | 825 | ○ | ◎ | ◎ | Δ | ○ | ○ | ○ | ○ |
| Ex. 4 | 1.58 | 0.25 | 6.3 | ○ | 825 | ○ | ◎ | ◎ | ○ | ○ | ○ | ○ | ○ |
| Ex. 5 | 1.13 | 0.27 | 4.2 | ○ | 825 | ○ | ○ | ◎ | ○ | ○ | ○ | ○ | ○ |
| Ex. 6 | 0.65 | 0.28 | 2.3 | ○ | 825 | ○ | Δ | Δ | ○ | ○ | ○ | ○ | ○ |
| Ex. 7 | 1.10 | 0.24 | 4.6 | ○ | 825 | ○ | ○ | ◎ | ○ | ○ | ○ | ○ | ○ |
| Ex. 8 | 1.10 | 0.24 | 4.6 | ○ | 825 | ○ | ○ | ◎ | ○ | ○ | ○ | ○ | ○ |
| Ex. 9 | 1.10 | 0.24 | 4.6 | ○ | 825 | ○ | ○ | ◎ | ○ | ○ | ○ | ○ | ○ |
| Ex. 10 | 1.26 | 0.35 | 3.6 | ○ | 825 | ○ | ○ | ◎ | ○ | ○ | ○ | ○ | ○ |
| Ex. 11 | 1.02 | 0.23 | 4.4 | ○ | 825 | ○ | ○ | ◎ | ○ | ○ | ○ | ○ | ○ |
| Ex. 12 | 0.98 | 0.24 | 4.1 | ○ | 825 | ○ | ○ | ◎ | ○ | ○ | ○ | ○ | ○ |
| Ex. 13 | 1.05 | 0.24 | 4.4 | ○ | 825 | ○ | ○ | ◎ | ○ | ○ | ○ | ○ | ○ |
| Ex. 14 | 1.10 | 0.24 | 4.6 | ○ | 825 | ○ | ○ | ◎ | ○ | ○ | ○ | ○ | ○ |
| Ex. 15 | 1.10 | 0.24 | 4.6 | ○ | 825 | ○ | ○ | ◎ | ○ | ○ | ○ | ○ | ○ |

TABLE 4-continued

| | Physical properties of toner (reference) | | | | | | Evaluation results | | | | | | |
|---|---|---|---|---|---|---|---|---|---|---|---|---|---|
| | Maximum absorbance (810~870) | Maximum absorbance (870~1000) | Ratio | | Maximum absorbing peak (nm) | | Fixing properties | Smearing preventive property | Color repro-ducibility | Fogg-ing | Dot reproductibility | Fine-line reproductibility | Heat resis-tance |
| Ex. 16 | 1.10 | 0.24 | 4.6 | ○ | 825 | ○ | ○ | ◎ | ○ | ○ | ○ | ○ | ○ |
| Ex. 17 | 1.03 | 0.23 | 4.5 | ○ | 825 | ○ | ○ | ◎ | ○ | ○ | ○ | ○ | ○ |
| Ex. 18 | 1.13 | 0.25 | 4.5 | ○ | 825 | ○ | ○ | ◎ | ○ | ○ | ○ | ○ | ○ |
| Com. Ex. 1 | 0.18 | 0.24 | 0.8 | X | 940 | X | X | X | ○ | ○ | ○ | ○ | ○ |
| Com. Ex. 2 | 0.25 | 0.17 | 1.5 | X | 760 | X | X | X | ○ | ○ | ○ | ○ | ○ |
| Com. Ex. 3 | 0.25 | 0.25 | 1.0 | X | 760 | X | X | X | Δ | ○ | ○ | ○ | ○ |
| Com. Ex. 4 | 0.23 | 0.25 | 0.9 | X | 760 | X | X | X | Δ | ○ | ○ | ○ | ○ |
| Com. Ex. 5 | 0.25 | 0.25 | 1.0 | X | 760 | X | X | X | X | ○ | ○ | ○ | ○ |
| Com. Ex. 6 | 0.18 | 0.28 | 0.6 | X | 940 | X | X | X | Δ | ○ | ○ | ○ | ○ |

Evaluation Methods for Various Physical Properties

Measuring Method for Glass Transition Point (Tg)

A differential scanning calorimeter (DSC-200: made by Seiko Instruments Inc.) was used in which: 10 mg of a sample to be measured was precisely weighed, and this was put into an aluminum pan, while alumina was put into an aluminum pan so as to be used as reference, and was heated to 200° C. from normal temperature at a temperature-rise rate of 30° C./min, and this was then cooled, and subjected to measurements in the range of 20° C. to 120° C. at a temperature-rise rate of 10° C./min; thus, during this temperature-rise process, the shoulder value of the main heat-absorption peak in the range of 30° C. to 90° C. was defined as the glass transition point Tg.

Measuring Method for Softening Point (Tm)

A sample to be measured (1.0 g) was weighed, and a flow tester (CFT-500: made by Shimadzu Corp) was used in which: measurements were made under conditions of the application of a die having a size of h 1.0 mm×ϕ1.0 mm, a temperature rise rate of 3.0° C./min, a pre-heating time of 180 seconds, a load of 30 kg and a measuring temperature range of 60 to 140° C., and the temperature at the time of the ½ flow of the above-mentioned sample was defined as the softening point (Tm).

Measuring Method for Acid Value

With respect to the acid value, 10 mg of a sample was dissolved in 50 ml of toluene, and this was titrated by a solution of N/10 potassium hydroxide/alcohol that had been preliminarily set, using an mixed indicator of 0.1% of bromo-thymol blue and phenol red; thus, the value was calculated from the amount of consumption of the solution of N/10 potassium hydride/alcohol.

Hydroxyl Value

With respect to the hydroxyl value, a weighed sample was treated by acetic anhydride, and an acetyl compound thus obtained was subjected to hydrolysis so that the number of mg of potassium hydroxide required for neutralizing isolated acetic acid was taken.

THF Insoluble Components

THF insoluble components were measured by Soxhlet extraction for 10 hours using tetrahydrofran as a solvent.

By using cyan toner of example 10, magenta toner of example 1 and yellow toner of example 11 with the amount of toner adhesion on paper having superposed three layers of colors Y, M and C being set to 12 g/m$^2$ (in the order of Y, M and C from the paper surface), the color reproducibility was evaluated.

By using black toner Bk in addition to the above-mentioned toners C, M and Y with the amount of toner adhesion on paper having superposed four layers of colors being set to 16 g/m$^2$ (in the order of Y, M, C and Bk from the paper surface), the fogging on images was evaluated.

The color reproducibility and fogging preventive property tend to deteriorate in the case of superposed toner layers in comparison with a single layer; however, the toner of the present invention makes it possible to provide superior properties in both of the color reproducibility and fogging preventive property.

The color toner of the present invention makes it possible to provide superior images in both of the fixing property and smearing preventive property, even in the case of comparatively small fixing energy.

What is claimed is:

1. A toner, comprising a binder resin, a colorant and at least two kinds of infrared absorbing agents, the toner having a maximum absorbance in a wavelength range of 810 to 870 nm that is greater than the maximum absorbance of the toner in a wavelength range of 870 to 1,000 nm.

2. The toner of claim 1, in which the maximum absorbance of the toner in a wavelength range of 810 to 870 nm is two or more times greater than the maximum absorbance of the toner in a wavelength range of 870 to 1,000 nm.

3. The toner of claim 1, in which the maximum absorbing peak is in a wavelength range of 810 to 840 nm.

4. The toner of claim 1, in which two kinds of infrared absorbing agents comprise a cyanine-based compound and an aminium-based compound.

5. The toner of claim 1, in which the infrared absorbing agents comprise an infrared absorbing compound having a maximum absorbance in a wavelength range of 800 to 870 nm and an infrared absorbing compound having a maximum absorbance in a wavelength range of 870 to 1,000 nm.

6. The toner of claim 5, in which the compound having the maximum absorbance in a wavelength range of 800 to 870 nm is selected from the group consisting of a polymethine-based compound, a cyanine-based compound and a mixture thereof.

7. The toner of claim 5, in which the compound having the maximum absorbance in a wavelength range of 870 to 1,000 nm is selected from the group consisting of a diimmonium-based compound, a phthalocyanine-based compound, an aminium-based compound and a mixture thereof.

8. The toner of claim 1, in which a total amount of addition of the infrared absorbing agent is within 0.01 to 2 parts by weight to 100 parts by weight of the binder resin.

9. The toner of claim 1, in which a ratio of an amount of the infrared absorbing agent having a maximum absorbance in a wavelength range of 800 to 870 nm and an amount of the infrared absorbing agent having a maximum absorbance in a wavelength range of 870 to 1,000 nm is within 1:4 to 4:1.

10. The toner of claim 1, in which the binder resin comprises a first polyester resin having a softening point in a range from 90 to 120° C. and a second polyester resin having a softening point in a range from 120 to 150° C.

11. The toner of claim 10, in which a weight ratio of the first polyester resin and the second polyester resin is in a range of 9:1 to 6:4.

12. The toner of claim 1, further comprising a low-melting point wax having a melting point of 55 to 85° C. and a polyolefin wax.

13. The toner of claim 12, in which the low-melting point wax is a synthetic ester wax.

14. The toner of claim 12, in which the polyolefin wax has a melting point of 80 to 150° C.

15. The toner of claim 12, in which a content of wax is within 0.5 to 5 parts by weight with respect to 100 parts by weight of the binder resin.

16. An image-forming method, comprising:

forming a toner image on a recording medium, and fixing the toner image on the recording medium, in which the toner comprises a binder resin, a colorant and at least two kinds of infrared absorbing agents, and the toner has a maximum absorbance of the toner in a wavelength range of 810 to 870 nm that is two or more times greater than the maximum absorbance of the toner in a wavelength range of 870 to 1,000 nm.

17. The image-forming method of claim 16, in which the image is fixed by a flash fixing system provided with a flash lamp.

18. The image-forming method of claim 17, in which the flash lamp has a light-emission spectrum peak in a wavelength range from 810 to 840 nm and a maximum absorbance of the toner is in a wavelength range of 810 to 840 nm.

19. The image-forming method of claim 17, an emitting energy of the flash lamp is in a range of 3.0 to 5.0 J/cm$^2$.

20. The image-forming method of claim 16, in which the infrared absorbing agents comprise an infrared absorbing compound having a maximum absorbance in a wavelength range of 800 to 870 nm and an infrared absorbing compound having a maximum absorbance in a wavelength range of 870 to 1,000 nm.

21. The image-forming method of claim 16, in which an amount of total adhesion of the toner on the recording medium is not more than 2 g/m$^2$.

* * * * *